US008580376B2

(12) United States Patent
Kinoshita et al.

(10) Patent No.: US 8,580,376 B2
(45) Date of Patent: Nov. 12, 2013

(54) CUTTING TOOL

(75) Inventors: Hideyoshi Kinoshita, Satsumasendai (JP); Takashi Tokunaga, Satsumasendai (JP)

(73) Assignee: Kyocera Corporation, Kyoto (JP)

( * ) Notice: Subject to any disclaimer, the term of this patent is extended or adjusted under 35 U.S.C. 154(b) by 351 days.

(21) Appl. No.: 13/056,302

(22) PCT Filed: Jul. 29, 2009

(86) PCT No.: PCT/JP2009/063471
§ 371 (c)(1),
(2), (4) Date: Jan. 27, 2011

(87) PCT Pub. No.: WO2010/013735
PCT Pub. Date: Feb. 4, 2010

(65) Prior Publication Data

US 2011/0129312 A1 Jun. 2, 2011

(30) Foreign Application Priority Data

Jul. 29, 2008 (JP) ..... 2008-194594
Aug. 28, 2008 (JP) ..... 2008-219251
Aug. 28, 2008 (JP) ..... 2008-219257

(51) Int. Cl.
*B32B 9/00* (2006.01)

(52) U.S. Cl.
USPC ..... 428/325; 51/307; 51/309; 428/323; 428/469; 428/472; 428/697; 428/698; 428/699

(58) Field of Classification Search
USPC ..... 51/307, 309; 428/323, 325, 469, 472, 428/697, 698, 699
See application file for complete search history.

(56) References Cited

U.S. PATENT DOCUMENTS 4,985,070 A * 1/1991 Kitamura et al. ..... 75/238
5,059,491 A * 10/1991 Odani et al. ..... 428/614
5,145,505 A 9/1992 Saito et al. ..... 75/238
5,296,016 A * 3/1994 Yoshimura et al. ..... 75/245

(Continued)

FOREIGN PATENT DOCUMENTS

JP 05-009646 1/1993
JP 06-017182 1/1994

(Continued)

*Primary Examiner* — Archene Turner
(74) *Attorney, Agent, or Firm* — DLA Piper LLP (US)

(57) ABSTRACT

Provided is a cutting tool which comprises a sintered cermet having high toughness and thermal shock resistance. The cutting tool, namely a tip 1, comprises a sintered cermet comprising: a hard phase 11 comprising one or more selected from among carbides, nitrides, and carbonitrides which comprise mainly Ti; and a binder phase 14 comprising mainly at least one of Co and Ni. The tip 1 has a cutting edge 4 lying along an intersecting ridge portion between a rake face 2 and a flank face 3, and a nose 5. The hard phase 11 comprises a first hard phase 12 and a second hard phase 13. When a residual stress is measured on the rake face 2 by 2D method, a residual stress $\sigma_{11}[1r]$ of the first hard phase 12 in a direction ($\sigma_{11}$ direction), which is parallel to the rake face 2 and goes from the center of the rake face 2 to the nose being the closest to a measuring point, is 50 MPa or below in terms of compressive stress ($\sigma_{11}[1r]$=−50 to 0 MPa), and a residual stress $\sigma_{11}[2r]$ of the second hard phase 13 in the $\sigma_{11}$ direction is 150 MPa or above in terms of compressive stress ($\sigma_{11}[2r] \leq -150$ MPa).

14 Claims, 7 Drawing Sheets

(56) References Cited

U.S. PATENT DOCUMENTS

| | | | | | |
|---|---|---|---|---|---|
| 5,447,549 | A | * | 9/1995 | Yoshimura | 75/245 |
| 5,577,424 | A | | 11/1996 | Isobe et al. | 75/236 |
| 5,766,742 | A | * | 6/1998 | Nakamura et al. | 428/469 |
| 5,976,213 | A | * | 11/1999 | Rolander et al. | 75/238 |
| 6,235,382 | B1 | * | 5/2001 | Matsubara | 428/325 |
| 7,811,683 | B2 | * | 10/2010 | Zhu et al. | 428/697 |
| 8,313,842 | B2 | * | 11/2012 | Kinoshita et al. | 428/698 |

FOREIGN PATENT DOCUMENTS

| | | | |
|---|---|---|---|
| JP | 07-179978 | | 7/1995 |
| JP | 09-323204 | * | 12/1997 |
| JP | 2004-115881 | | 4/2004 |
| JP | 2005-194573 | * | 7/2005 |
| JP | 2005-213599 | * | 8/2005 |
| JP | 2007-231421 | * | 9/2007 |
| JP | 2008-156756 | | 7/2008 |

* cited by examiner

CUTTING TOOL

CROSS-REFERENCE TO THE RELATED APPLICATIONS

This application is a national stage of international application No. PCT/JP2009/063471, filed on Jul. 29, 2009, and claims the benefit of priority under 35 USC 119 to Japanese Patent Application No. 2008-194594, filed on Jul. 29, 2008, Japanese Patent Application No. 2008-219251, filed on Aug. 28, 2008 and Japanese Patent Application No. 2008-219257, filed on Aug. 28, 2008, the entire contents of all of which are incorporated herein by reference.

TECHNICAL FIELD

The present invention relates to a cutting tool comprising a sintered cermet.

BACKGROUND ART

Cemented carbides composed mainly of WC, and sintered alloys such as cermets composed mainly of Ti (Ti-based cermets) are currently widely used as members requiring wear resistance and sliding properties, as well as fracture resistance, such as cutting tools, wear-resistant members, and sliding members. Developments of novel materials for improving performance of these sintered alloys are continued, and improvements of the characteristics of the cermets are also tried.

For example, patent document 1 discloses that wear resistance, fracture resistance, and thermal shock resistance are improved in the following method. That is, the concentration of a binder phase (iron-group metal) in the surface portion of a nitrogen-containing TiC-based cermet is decreased than that in the interior thereof so as to increase the ratio of a hard phase in the surface portion, thereby allowing a compression residual stress of 30 kgf/mm$^2$ or more to remain in the surface portion of the sintered body. Patent document 2 discloses that WC particles as primary crystals of WC-based cemented carbide have a compression residual stress of 120 kgf/mm$^2$ or more, whereby the WC-based cemented carbide has high strength and therefore exhibits excellent fracture resistance.

Patent document 1: Japanese Unexamined Patent Publication No. 05-9646

Patent document 2: Japanese Unexamined Patent Publication No. 06-17182

DISCLOSURE OF THE INVENTION

Problems to be Solved by the Invention

However, with the method of generating the residual stress in a sintered cermet by making a difference in the content of the binder phase between the surface and the interior as is the case with the patent document 1, it is difficult to obtain satisfactory toughness improvement effect, since the ratio of the binder phase content to the entire cermet is low, and therefore a sufficient residual stress is not applied to the entire cermet, Also with the method of uniformly applying a residual stress to the hard phase as in the case with the patent document 2, there was a limit to the improvement in the strength of the hard phase.

Therefore, the cutting tool of the present invention aims to solve the above problems and improve the fracture resistance of the cutting tool by enhancing the toughness of the sintered cermet.

Means for Solving the Problems

According to a first aspect of the cutting tool of the present invention, the cutting tool comprises a sintered cermet comprising: a hard phase composed of one or more selected from among carbides, nitrides, and carbonitrides which comprise mainly Ti and contain one or more metals selected from among metals of Groups 4, 5, and 6 in the periodic table and a binder phase comprising mainly at least one of Co and Ni. The cutting tool includes a cutting edge which lies along an intersecting ridge portion between a rake face and a flank face, and a nose lying on the cutting edge located between the flank faces adjacent to each other. The hard phase comprises two kinds of phases, which include a first hard phase and a second hard phase. When a residual stress is measured in the rake face by 2D method, a residual stress $\sigma_{11}[\mathbf{1}r]$ of the first hard phase in a direction ($\sigma_{11}$ direction), which is parallel to the rake face and goes from the center of the rake face to the nose being the closest to a measuring point, is 50 MPa or below in terms of compressive stress ($\sigma_{11}[\mathbf{1}r]=-50$ to 0 MPa), and a residual stress $\sigma_{11}[\mathbf{2}r]$ of the second hard phase in the $\sigma_{11}$ direction is 150 MPa or above in terms of compressive stress ($\sigma_{11}[\mathbf{2}r]\leq-150$ MPa).

Preferably, the ratio of the residual stress $\sigma_{11}[\mathbf{1}r]$ of the first hard phase in the direction $\sigma_{11}$ and the residual stress $\sigma_{11}[\mathbf{2}r]$ of the second hard phase in the direction $\sigma_{11}$ ($\sigma_{11}[\mathbf{1}r]/\sigma_{11}[\mathbf{2}r]$) is 0.05 to 0.3.

Preferably, the residual stress $\sigma_{11}[\mathbf{2}rA]$ of the second hard phase measured in the vicinity of the cutting edge in the rake face has a smaller absolute value than the residual stress $\sigma_{11}[\mathbf{2}rB]$ of the second hard phase measured at the center of the rake face.

Preferably, a residual stress $\sigma_{22}[\mathbf{1}r]$ of the first hard phase in a direction ($\sigma_{22}$ direction), which is parallel to the rake face and vertical to the $\sigma_{11}$ direction, is 50 to 150 MPa in terms of compressive stress ($\sigma_{22}[\mathbf{1}r]=-150$ to $-50$ MPa), and a residual stress $\sigma_{22}[\mathbf{2}r]$ of the second hard phase in the $\sigma_{22}$ direction is 200 MPa or above in terms of compressive stress ($\sigma_{22}[\mathbf{2}r]\leq-200$ MPa).

Preferably, the ratio of $d_{1i}$ and $d_{2i}$ ($d_{2i}/d_{1i}$) in an inner of the cutting tool, where $d_{1i}$ is a mean particle diameter of the first hard phase and $d_{2i}$ is a mean particle diameter of the second hard phase, is 2 to 8.

Preferably, the ratio of $S_{1i}$ and $S_{2i}$ ($S_{2i}/S_{1i}$), where $S_{1i}$ is a mean area occupied by the first hard phase and $S_{2i}$ is a mean area occupied by the second hard phase with respect to the entire hard phases, is 1.5 to 5.

According to a second aspect of the present invention, when a residual stress is measured by the 2D method on the surface of the sintered cermet which corresponds to the flank face immediately below the cutting edge, a residual stress $\sigma_{11}[\mathbf{2}sf]$ of the second hard phase in a direction ($\sigma_{11}$ direction), which is parallel to the rake face and is an in-plane direction of the flank face, is 200 MPa or above in terms of compressive stress ($\sigma_{11}[\mathbf{2}sf]\leq-200$ MPa). When a residual stress is measured by the 2D method on a ground surface obtained by grinding 400 μm or more from the surface of the sintered cermet which corresponds to the flank face immediately below the cutting edge, a residual stress $\sigma_{11}[\mathbf{2}if]$ in the $\sigma_{11}$ direction is 150 MPa or above in terms of compressive stress ($\sigma_{11}[\mathbf{2}if]\leq-150$ MPa), and has a smaller absolute value than the residual stress $\sigma_{11}[\mathbf{2}sf]$.

When a residual stress is measured by the 2D method on the surface of the sintered cermet which corresponds to the flank face immediately below the cutting edge, a residual stress $\sigma_{11}[\mathbf{1}sf]$ of the first hard phase in the $\sigma_{11}$ direction is preferably 70 to 180 MPa in terms of compressive stress ($\sigma_{11}$[1*sf*]=−180 to −70 MPa). When a residual stress is measured by the 2D method on a ground surface obtained by grinding 400 μm or more from the surface of the sintered cermet in the flank face, a residual stress $\sigma_{11}$[1*if*] in the $\sigma_{11}$ direction is preferably 20 to 70 MPa in terms of compressive stress ($\sigma_{11}$[1*if*]=−70 to −20 MPa), and preferably has a smaller absolute value than the residual stress $\sigma_{11}$[1*sf*].

More preferably, the ratio of the residual stress $\sigma_{11}$[1*sf*] and the residual stress $\sigma_{11}$[2*sf*] ($\sigma_{11}$[2*sf*]/$\sigma_{11}$[1*sf*]) is 1.2 to 4.5.

Preferably, the ratio of $S_{1i}$ and $S_{2i}$ ($S_{2i}/S_{1i}$) where $S_{1i}$ is a mean area occupied by the first hard phase, and $S_{2i}$ is a mean area occupied by the second hard phase with respect to the entire hard phases in the interior of the sintered cermet, is 1.5 to 5. Preferably, in the surface of the sintered cermet, a surface region exists in which the ratio of $S_{1s}$ and $S_{2s}$ ($S_{2s}/S_{1s}$), where $S_{1s}$ is a mean area occupied by the first hard phase, and $S_{2s}$ is a mean area occupied by the second hard phase with respect to the entire hard phases, is 2 to 10.

More preferably, the ratio of $S_{2i}$ and $S_{2s}$ ($S_{2s}/S_{2i}$) is 1.5 to 5.

According to a third aspect of the present invention, a coating layer is formed on the surface of a base comprising the sintered cermet. When a residual stress on the flank face is measured on the flank face by the 2D method, a residual stress $\sigma_{11}$[2*cf*] of the second hard phase in a direction ($\sigma_{11}$ direction), which is parallel to the rake face and is an in-plane direction of the flank face, is 200 MPa or above in terms of compressive stress ($\sigma_{11}$[2*cf*]≤−200 MPa), and the residual stress $\sigma_{11}$[2*cf*] is 1.1 times or more a residual stress ($\sigma_{11}$[2*nf*]) of the second hard phase of the sintered cermet before forming the coating layer in the $\sigma_{11}$ direction.

Preferably, the coating layer comprising $Ti_{1-a-b-c-d}Al_aW_bSi_cM_d(C_xN_{1-x})$, where M is one or more selected from among Nb, Mo, Ta, Hf, and Y, 0.45≤a≤0.55, 0.01≤b≤0.1, 0≤c≤0.05, 0≤d≤0.1, and 0≤x≤1, is formed on the surface of the cermet.

Effect of the Invention

According to the cutting tool in the first aspect of the present invention, the hard phases constituting the sintered cermet comprise two kinds of hard phases, namely, the first hard phase and the second hard phase. According to the first aspect, when the residual stress is measured on the rake face of the cutting tool by the 2D method, the residual stress $\sigma_{11}$[1*r*] of the first hard phase in the direction ($\sigma_{11}$ direction), which is parallel to the rake face and goes from the center of the rake face to the nose being the closest to a measuring point, is 50 MPa or below in terms of compressive stress ($\sigma_{11}$[1*r*]=−50 to 0 MPa), and the residual stress $\sigma_{11}$[2*r*] of the second hard phase in the $\sigma_{11}$ direction is 150 MPa or above in terms of compressive stress ($\sigma_{11}$[2*r*]≤−150 MPa). That is, under compressive stresses of different dimensions exerted on these two types of hard phases, it becomes difficult for a crack to run into the grains of these hard phases, and it is capable of reducing the occurrence of a portion that facilitates the crack propagation by the tensile stress exerted on the grain boundary between these two hard phases. This improves the toughness of these hard phases of the sintered cermet, thus improving the fracture resistance of the cutting tool.

The ratio of the residual stress in the direction $\sigma_{11}$ of the first hard phase and that of the second hard phase ($\sigma_{11}$[1*r*]/$\sigma_{11}$[2*r*]) is preferably 0.05 to 0.3 for the purpose of improving the toughness of the sintered cermet. Preferably, the residual resistance $\sigma_{11}$[2*rA*] of the second hard phase measured in the vicinity of the cutting edge of the rake face has a smaller absolute value than the residual resistance $\sigma_{11}$[2*rB*] of the second hard phase measured at the center of the rake face, in order to compatibly satisfying the unti-deformation at a center portion of the rake face and the fracture resistance of the cutting edge.

With regard to the residual stresses in the direction ($\sigma_{22}$ direction) vertical to the $\sigma_{11}$ direction and parallel to the rake face which are measured on the main surface of the sintered cermet by the 2D method, the residual stress $\sigma_{22}$[1*r*] exerted on the first hard phase is preferably 50 to 150 MPa or below, and the residual stress $\sigma_{22}$[2*r*] exerted on the second hard phase is preferably 200 MPa or above, for the purpose of improving the thermal shock resistance of the cutting tool.

In the inner structure of the sintered cermet, the ratio of $d_{1i}$ and $d_{2i}$ ($d_{2i}/d_{1i}$), where $d_{1i}$ is a mean particle diameter of the first hard phase, and $d_{2i}$ is a mean particle diameter of the second hard phase 13, is preferably 2 to 8, for the purpose of controlling the residual stresses of the first hard phase and the second hard phase.

Further, the ratio of $S_{1i}$ and $S_{2i}$ ($S_{2i}/S_{1i}$), where $S_{1i}$ is a mean area occupied by the first hard phase, and $S_{2i}$ is a mean area occupied by the second hard phase 13 with respect to the entire hard phases in the interior of the sintered cermet, is preferably 1.5 to 5, for the purpose of controlling the residual stresses of the first hard phase 12 and the second hard phase 13.

According to the cutting tool in the second aspect of the present invention, the residual stress $\sigma_{11}$[2*sf*] in the surface of the flank face of the sintered cermet is 200 MPa or above in terms of compressive stress ($\sigma_{11}$[2*sf*]≤−200 MPa), and the residual stress in the ground surface of the sintered cermet is 150 MPa or above in terms of compressive stress ($\sigma_{11}$[2*if*]≤−150 MPa), and has a smaller absolute value than the stress $\sigma_{11}$[2*sf*]. Thereby, a large residual compressive stress can be generated in the surface of the sintered cermet, thereby reducing the crack propagation upon the occurrence thereof in the surface of the sintered body. This reduces the occurrences of chipping and fracture, and also enhances the impact strength in the interior of the sintered cermet.

The residual stress $\sigma_{11}$[1*sf*] of the first hard phase in the surface of the sintered cermet is 70 to 180 MPa ($\sigma_{11}$[1*sf*]=−180 to −70 MPa) in terms of compressive stress, and the residual stress $\sigma_{11}$[1*if*] in the ground surface is 20 to 70 MPa ($\sigma_{11}$[1*if*]=−70 to −20 MPa) in terms of compressive stress and has a smaller absolute value than the residual stress $\sigma_{11}$[1*sf*]. These are desirable in the following points that no crack is propagated into the hard phases themselves owing to the residual stress difference between the first hard phase and the second hard phase, and that the thermal shock resistance in the surface of the sintered cermet is improved.

When the residual stresses are measured on the surface of the sintered cermet which corresponds to the flank face immediately below the cutting edge, the ratio of the residual stress $\sigma_{11}$[1*sf*] in the $\sigma_{11}$ direction of the first hard phase and the residual stress $\sigma_{11}$[2*sf*] in the $\sigma_{11}$ direction of the second hard phase, ($\sigma_{11}$[2*sf*]/$\sigma_{11}$[1*sf*]), is 1.2 to 4.5. This achieves high thermal shock resistance in the surface of the sintered cermet.

Further, the ratio of $S_{1i}$ and $S_{2i}$ ($S_{2i}/S_{1i}$), where $S_{1i}$ is a mean area occupied by the first hard phase, and $S_{2i}$ is a mean area occupied by the second hard phase with respect to the entire hard phases in the interior of the sintered cermet, is preferably 1.5 to 5, for the purpose of controlling the residual stresses of the first hard phase and the second hard phase.

Preferably, in the surface of the sintered cermet, a surface region exists in which the ratio of $S_{1s}$ and $S_{2s}$ ($S_{2s}/S_{1s}$), where $S_{1s}$ is a mean area occupied by the first hard phase, and $S_{2s}$ is a mean area occupied by the second hard phase with respect to the entire hard phases, is 2 to 10. Thereby, the residual stress in the surface of the sintered cermet can be controlled within a predetermined range. More preferably, the ratio of $S_{2i}$ and $S_{2s}$ ($S_{2s}/S_{2i}$) is 1.5 to 5, for achieving easy control of the residual stress difference between the surface of the sintered cermet and the interior thereof.

According to the third aspect of the present invention, when a residual stress is measured on the flank face by the 2D method, the residual stress in the $\sigma_{11}$ direction in the second hard phase of the surface portion of the sintered cermet with the coating layer formed thereon is 200 MPa or above ($\sigma_{11}$ [2*cf*]≤−200 MPa) in terms of compressive stress, which is 1.1 times or more the residual stress of the second hard phase $\sigma_{11}$[2*nf*] in the surface portion of the sintered cermet without the coating layer (corresponding to the $\sigma_{11}$[2*sf*] in the second aspect). Thereby, a predetermined range of compressive stresses can be applied to the surface of the sintered cermet, and hence the thermal shock resistance of the sintered cermet is improved. Consequently, even in the cutting tool with the coating layer, the thermal shock resistance and fracture resistance thereof are improved.

Preferably, the coating layer comprising $Ti_{1-a-b-c-d}Al_aW_bSi_cM_d(C_xN_{1-x})$, where M is one or more selected from among Nb, Mo, Ta, Hf, and Y, 0.45≤a≤0.55, 0.01≤b≤0.1, 0≤c≤0.05, 0≤d≤0.1, and 0≤x≤1 is formed on the surface of the cermet. This enables control of the residual stress in the surface of the sintered cermet, and also imparts high hardness and improved wear resistance to the coating layer itself.

BRIEF EXPLANATION OF THE DRAWINGS

FIG. 1(*b*) is a sectional view taken along the line X-X in FIG. 1(*a*), showing a measuring portion when a residual stress is measured on a rake face;

FIG. 4(*b*) is a side view viewed from the direction A in FIG. 4(*a*), showing a measuring portion when a residual stress is measured on a flank face;

FIG. 6(*b*) is a side view viewed from the direction A in FIG. 6(*a*), showing a measuring portion when a residual stress is measured on a flank face.

PREFERRED EMBODIMENTS FOR CARRYING OUT THE INVENTION

As an example of the cutting tool of the present invention, a throw-away tip of negative tip shape whose rake face and seating surface are identical to each other is explained with reference to FIG. 1(*a*) that is the schematic top view thereof, FIG. 1(*b*) that is the sectional view taken along the line X-X in FIG. 1(*a*), and FIG. 2 that is the scanning electron microscope photograph of the cross section of the sintered cermet 6 constituting the throw-away tip 1.

Figure 1:
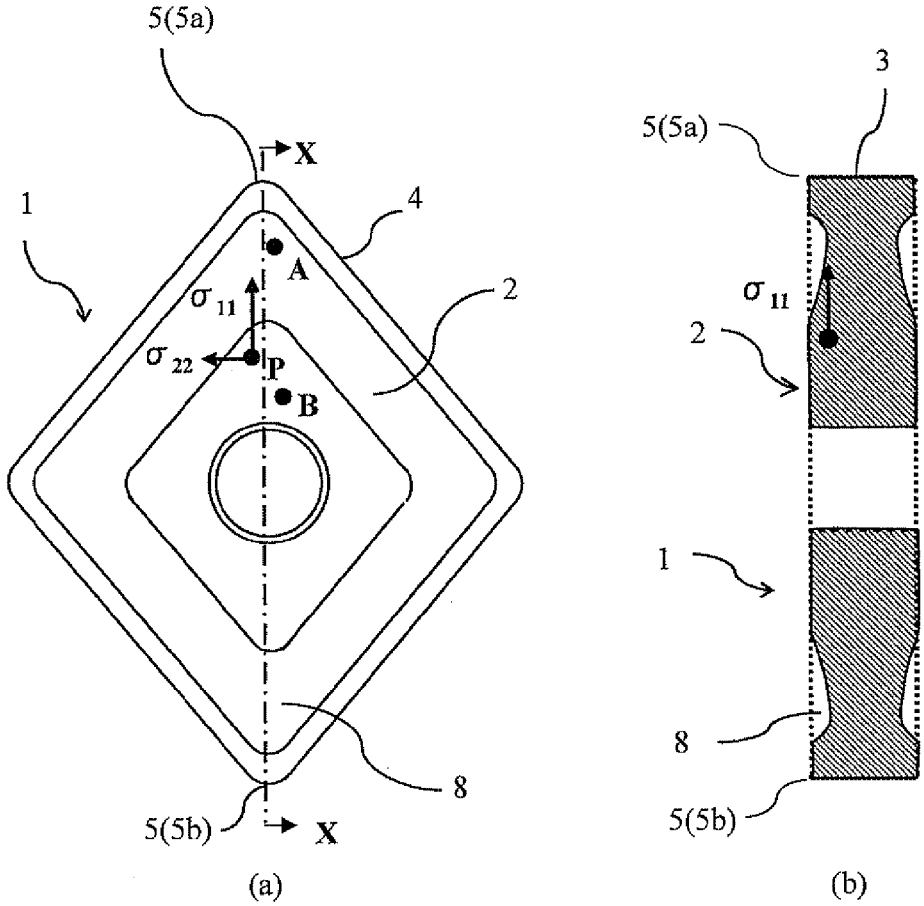
FIG. 1(*a*) is a schematic top view of a throw-away tip as an example of the cutting tool of the present invention.

The throw-away tip (hereinafter referred to simply as "tip") 1 in FIG. 1(*a*) to FIG. 2 has a substantially flat plate shape as shown in FIGS. 1(*a*) and 1(*b*), in which the rake face 2 is disposed on a main surface thereof, the flank face 3 is disposed on a side face, and a cutting edge 4 lies along an intersecting ridge portion between the rake face 2 and the flank face 3.

The rake face 2 has a polygonal shape such as a rhombus, triangle, or square (in FIGS. 1(*a*) and 1(*b*), a rhombus shape with acute apex angles of 80 degrees is used as example). These acute apex angles (5*a*, 5*b*) among the apex angles of the polygonal shape are kept in contact with a work portion of a work material and perform cutting.

Figure 2:
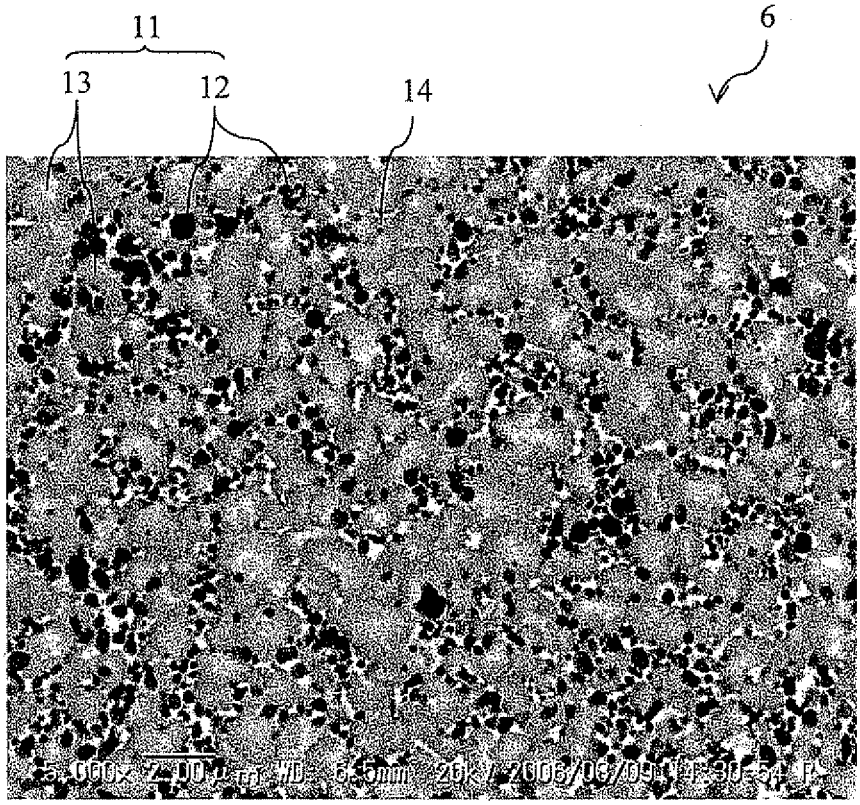
FIG. 2 is a scanning electron microscope photograph of a cross section of a sintered cermet constituting the throw-away tip of FIGS. 1(*a*) and 1(*b*)

As shown in FIG. 2, the sintered cermet 6 constituting the tip 1 comprising a hard phase 11 which comprises one or more selected from carbides, nitrides and carbonitrides of metals selected from among Group 4, Group 5, and Group 6 of the periodic table, each of which is composed mainly of Ti, and a binder phase 14 comprising mainly at least one of Co and Ni. The hard phase 11 comprises two types of hard phases, namely, a first hard phase 12 and a second hard phase 13.

The composition of the first hard phase 12 is selected from the metal elements of Group 4, Group 5, and Group 6 of the periodic table, and contains 80% by weight or more of Ti element. The composition of the second hard phase 13 is selected from the metal elements of Group 4, Group 5, and Group 6 of the periodic table, and contains 30% or more and below 80% by weight of Ti element. Therefore, when the sintered cermet 6 is observed by the scanning electron microscope, the first hard phase 12 is observed as black grains because it has a higher content of light elements than the second hard phase 13.

Figure 3:
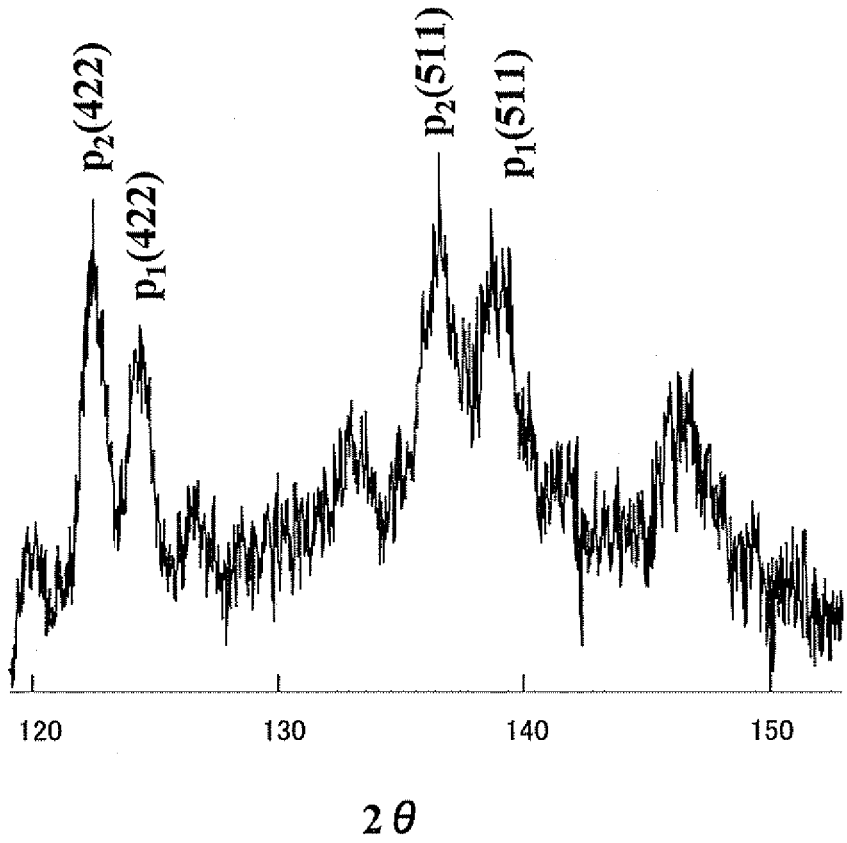
FIG. 3 is an example of X-ray diffraction charts measured through the rake face in the throw-away tip of FIGS. 1(*a*) and 1(*b*)

As shown in FIG. 3, in an X-ray diffraction measurement, two peaks assigned to the (422) plane of Ti(C)N, namely, a peak $p_1$ (422) of the first hard phase 12 and a peak $p_2$ (422) of the second hard phase 13 are observed. Similarly, two peaks assigned to the (511) plane of Ti(C)N, namely, a peak $p_1$ (511) of the first hard phase 12 and a peak $p_2$ (511) of the second hard phase 13 are observed. These two peaks of the first hard phase 12 are observed on a higher angle side than those of the second hard phase 13.

First Embodiment

According to the first embodiment of the present invention, when a residual stress is measured on the rake face 2 of the tip 1 by the 2D method, the residual stress $\sigma_{11}$[1*r*] in a direction ($\sigma_{11}$ direction) which is parallel to the rake face 2 of the first hard phase 12 and goes from the center of the rake face 2 to the nose 5 being the closest to a measuring point is in the range of 50 MPa or below in terms of compressive stress ($\sigma_{11}$[1*r*]=−50 to 0 MPa), particularly 50 MPa to 15 MPa ($\sigma_{11}$[1*r*]=−50 to 15 MPa). The residual stress $\sigma_{11}$[2*r*] exerted on the second hard phase 13 is in the range of 150 MPa or above in terms of compressive stress ($\sigma_{11}$[2*r*]≤−150 MPa), particularly 150 MPa to 350 MPa ($\sigma_{11}$[2*r*]=−350 to −150 MPa). Consequently, compressive stresses of different dimensions are exerted on these two types of hard phases, and hence the grains of the hard phases 11 are unsusceptible to cracks, and it is capable of reducing the occurrence of a portion that facilitates the crack propagation by the tensile stress exerted on the grain boundary between these two hard phases 11. This improves the toughness of the hard phases of the sintered cermet 6, thereby improving the fracture resistance of the tip 1.

That is, when the residual stress $\sigma_{11}[1r]$ exerted on the first hard phase 12 is larger than 50 MPa, there is a risk that the stress exerted on the first hard phase 12 may become extremely strong, thus causing fracture in the grain boundary between the hard phases 11, or the like. When the residual stress $\sigma_{11}[2r]$ exerted on the second hard phase 13 is smaller than 150 MPa, a sufficient residual stress cannot be exerted on the hard phases 11, failing to improve the toughness of the hard phases 11.

In the measurements of the residual stresses $\sigma_{11}[1r]$ and $\sigma_{22}[1r]$ in the rake face of the present invention, the measurement is carried out at the position P 1 mm or more toward the center from the cutting edge in order to measure the residual stress inside the sintered cermet. As an X-ray diffraction peak used for measuring the residual stress, the peaks of the (422) plane are used in which the value of 2θ appears between 120 and 125 degrees as shown in FIG. 3. On this occasion, the residual stresses of the hard phases 11 are measured by taking a peak $p_2$ (422) that appears on the low angle side as a peak assigned to the second hard phase 13, and a peak $p_1$ (422) that appears on the high angle side as a peak assigned to the first hard phase. These residual stresses are calculated by using the Poisson's ratio of 0.20 and Young's modulus of 423729 MPa of titanium nitride. With regard to the X-ray diffraction measurement conditions, the residual stresses are measured by subjecting the mirror-finished rake face to irradiation using CuKα ray as the X-ray source at an output of 45 kV and 110 mA.

For the purpose of compatibly satisfying the deformation resistance at a middle portion of the rake face 2 and the fracture resistance of the cutting edge 4, it is desirable that a residual resistance $\sigma_{11}[2rA]$ of the second hard phase 13 measured in the vicinity of the cutting edge 4 of the rake face 2 have a smaller absolute value than a residual resistance $\sigma_{11}[2rB]$ of the second hard phase 13 measured at the center of the rake face 2.

When the rake face 2 has a recessed portion like a breaker groove 8 as in the tool shape of FIGS. 1(*a*) and 1(*b*), the measurement is carried out on a flat portion other than the recessed portion. When the amount of such a flat portion is small, the measurement is carried out on a flat portion ensured by applying a 0.5 mm thick mirror finishing to the rake face of the sintered cermet 6 in order to minimize the stress exerted thereon.

The ratio of the residual stress of the first hard phase 12 and that of the second hard phase 13 in the direction $\sigma_{11}$, namely, $\sigma_{11}[1r]/\sigma_{11}[2r]$ is preferably in the range of 0.05 to 0.3, particularly 0.1 to 0.25, for the purpose of improving the toughness of the sintered cermet 6.

With regard to the residual stress in a direction ($\sigma_{22}$ direction) which is parallel to the rake face of the first hard phase 12 and vertical to the direction $\sigma_{11}$ and parallel to the rake face, the residual stress $\sigma_{22}[1r]$ exerted on the first hard phase is preferably in the range of 50 to 150 MPa ($\sigma_{22}[1r]=-150$ to $-50$ MPa), particularly 50 to 120 MPa ($\sigma_{22}[1r]=-120$ to $-50$ MPa) in terms of compressive stress, and the residual stress $\sigma_{22}[2r]$ of the second hard phase 13 in the $\sigma_{22}$ direction is preferably 200 MPa or above ($\sigma_{22}[2r]\leq-200$ MPa) in terms of compressive stress. This is because thermal shock resistance indicating fracture properties due to the heat generated in the cutting edge 4 of the tip 1 can be enhanced to further improve fracture resistance.

With regard to the structure of the hard phases 11, it is preferable to include the hard phase 11 with a core-containing structure that the second hard phase 14 surrounds the first hard phase 12. With this structure, the residual stress is optimized within this hard phase 11. Even when a crack propagates around the hard phase 11 with the core-containing structure, the crack propagation can be reduced, thereby further improving the toughness of the sintered cermet.

In the interior of the sintered cermet structure, the ratio of $d_{1i}$ and $d_{2i}$ ($d_{2i}/d_{1i}$), where $d_{1i}$ is a mean particle diameter of the first hard phase 12, and $d_{2i}$ is a mean particle diameter of the second hard phase 13, is preferably 2 to 8, for the purpose of controlling the residual stresses of the first hard phase 12 and the second hard phase 13. The mean particle diameter d of the entire hard phases 11 in the interior of the sintered cermet 6 is preferably 0.3 to 1 μm, in order to impart a predetermined residual stress.

Further, the ratio of $S_{1i}$ and $S_{2i}$ ($S_{2i}/S_{1i}$), where $S_{1i}$ is a mean area occupied by the first hard phase 12, and $S_{2i}$ is a mean area occupied by the second hard phase 13 with respect to the entire hard phases 11 in the interior of the sintered cermet, is preferably 1.5 to 5, for the purpose of controlling the residual stresses of the first hard phase 12 and the second hard phase 13.

In the surface region of the sintered cermet 6, the ratio of $S_{1s}$ and $S_{2s}$ ($S_{2s}/S_{1s}$), where $S_{1s}$ is a mean area occupied by the first hard phase 12, and $S_{2s}$ is a mean area occupied by the second hard phase 13 with respect to the entire hard phases 11 in the surface region, is preferably 2 to 10. Thereby, the residual stress in the surface of the sintered cermet 6 can be controlled within a predetermined range.

The ratio of $S_{1i}$ and $S_{2i}$ ($S_{2i}/S_{1i}$), where $S_{1i}$ is a mean area occupied by the first hard phase 12, and $S_{2i}$ is a mean area occupied by the second hard phase 13 with respect to the entire hard phases 11 in the interior of the sintered cermet 6, is preferably 1.5 to 5. Thereby, the residual stress in the interior of the sintered cermet 6 can be controlled within a predetermined range.

Second Embodiment

According to a second embodiment of the present invention, when the residual stress in the flank face 3 immediately below the cutting edge 4 of the tip 1 is measured on the surface of the sintered cermet 6 by the 2D method, the residual stress $\sigma_{11}[2sf]$ in a direction, which is parallel to the rake face 2 and is an in-plane direction of the flank face 3 (hereinafter referred to as an direction), is 200 MPa or above ($\sigma_{11}[2sf]\leq-200$ MPa) in terms of compressive stress. When a residual stress is measured by the 2D method on the ground surface obtained by grinding off a thickness of 400 μm or more from the surface of the sintered cermet 6 in the flank face 3 (hereinafter referred to as ground surface), the residual stress $\sigma_{11}[2if]$ in the $\sigma_{11}$ direction is 150 MPa or more ($\sigma_{11}[2if]\leq-150$ MPa) in terms of compressive stress, and this residual stress has a smaller absolute value than the residual stress $\sigma_{11}[2sf]$.

Hence, a large compressive stress can be generated on the surface of the sintered cermet 6, and it is therefore capable of reducing the crack propagation when generated in the surface of the sintered cermet 6, thereby reducing the occurrences of chipping and fracture. It is also capable of reducing the fracture of the sintered cermet 6 due to shock in the interior of the sintered cermet 6.

That is, when the residual stress $\sigma_{11}[2sf]$ exerted on the second hard phase 13 in the surface of the sintered cermet 6 is smaller than 200 MPa ($\sigma_{11}[2sf]>-200$ MPa) in terms of compressive stress, and when the residual stress $\sigma_{11}[2if]$ in the ground surface of the sintered cermet 6 is smaller than 150 MPa ($\sigma_{11}[2if]>-150$ MPa) in terms of compressive stress, the residual stress in the surface of the sintered cermet 6 cannot be exerted on the hard phases 11, failing to improve the toughness of the hard phases 11. When the residual stress $\sigma_{11}[\mathbf{2}if]$ has a larger absolute value than that of the residual stress $\sigma_{11}[\mathbf{2}sf]$ (has a higher compressive stress), a sufficient residual stress cannot be exerted on the hard phases 11 in the surface of the sintered cermet 6, failing to reduce the chipping and fracture in the surface of the sintered cermet 6. In some cases, the shock resistance in the interior of the sintered cermet 6 may be deteriorated, resulting in the fracture of the tip 1.

Hereat, the residual stress $\sigma_{11}[\mathbf{1}sf]$ of the first hard phase in the surface of the sintered cermet 6 is 70 to 180 MPa ($\sigma_{11}[\mathbf{1}sf]$=−180 to −70 MPa) in terms of compressive stress, and the residual stress $\sigma_{11}[\mathbf{1}if]$ in the ground surface is 20 to 70 MPa ($\sigma_{11}[\mathbf{1}if]$=−70 to −20 MPa) in terms of compressive stress, and has a smaller absolute value than that of the residual stress $\sigma_{11}[\mathbf{1}sf]$. These are desirable in the following points that no crack is propagated into the hard phases 11 themselves owing to the residual stress difference between the first hard phase 12 and the second hard phase 13, and that the thermal shock resistance in the surface of the sintered cermet 6 is improved. Thereby, compressive stresses of different dimensions are exerted on these two types of hard phases. This makes it difficult for a crack to run into the grains of these hard phases 11, and also reduces the occurrence of a portion that facilitates the crack propagation by the tensile stress exerted on the grain boundary between these hard phases 11. Consequently, the toughness of the hard phases 11 of the sintered cermet 6 is improved, and hence the fracture resistance of the tip 1 is improved.

When the residual stress is measured by the 2D method on the surface of the sintered cermet 6 in the flank face 3, the ratio of the residual stress $\sigma_{11}[\mathbf{1}sf]$ of the first hard phase 12 in the $\sigma_{11}$ direction and the residual stress $\sigma_{11}[\mathbf{2}sf]$ of the second hard phase 13 in the $\sigma_{11}$ direction ($\sigma_{11}[\mathbf{2}sf]/\sigma_{11}[\mathbf{1}sf]$) is 1.2 to 4.5. This imparts high thermal shock resistance to the surface of the sintered cermet 6.

Figure 4:
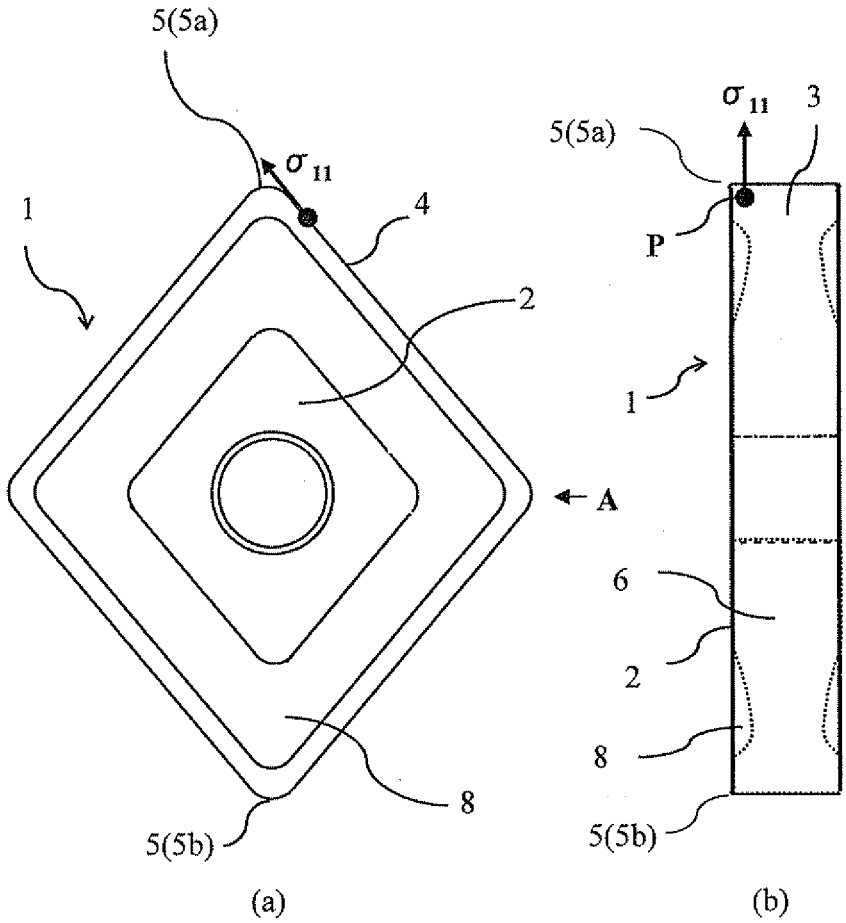
FIG. 4(*a*) is a schematic top view of a throw-away tip as an example of a second embodiment of the cutting tool of the present invention.
Figure 5:
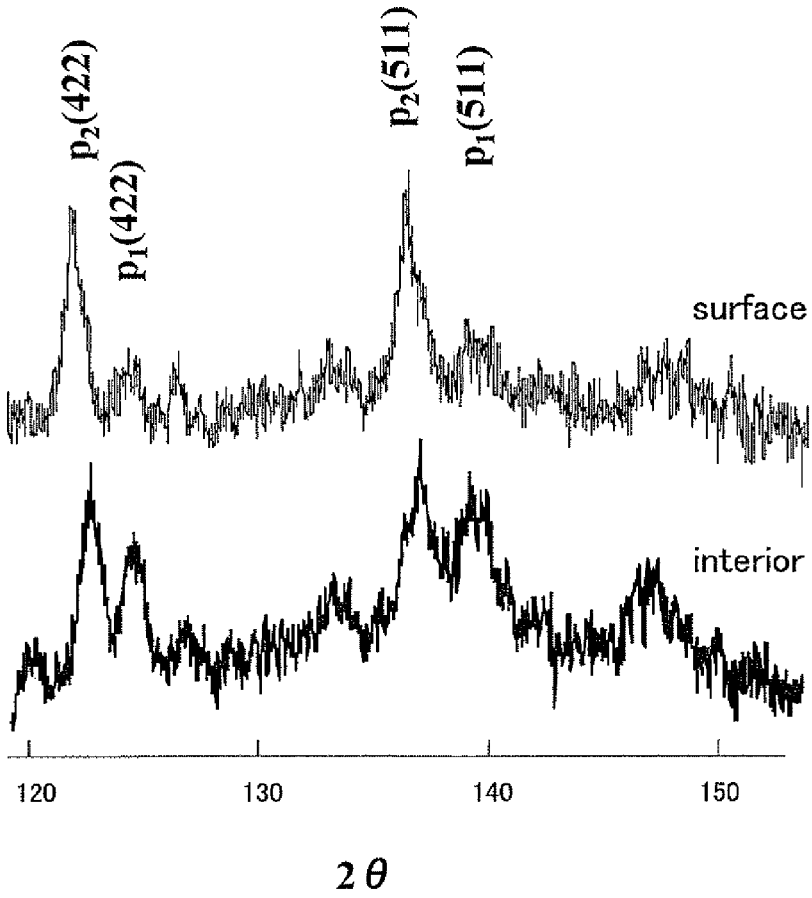
FIG. 5 is an example of X-ray diffraction charts measured on the flank face of the throw-away tip of FIGS. 4(*a*) and 4(*b*)

With regard to the measurements of the residual stress in the present embodiment, in order to measure the residual stress in the interior of the sintered cermet, the measurement is carried out at a measuring position P in the interior thereof which is mirror-finished by grinding a depth of 400 μm or more from the cutting edge, as shown in FIGS. 4(*a*) and 4(*b*). The measuring conditions of X-ray diffraction peaks and residual stresses used for measuring the residual stresses are identical to those in the first embodiment. FIGS. 4(*a*) and 4(*b*) show the measuring position of the residual stresses in the present embodiment. FIG. 5 shows an example of the X-ray diffraction peaks used for measuring the residual stresses.

The ratio of the residual stress of the first hard phase 12 and the residual stress of the second hard phase 13 in the $\sigma_{11}$ direction, $\sigma_{11}[\mathbf{2}sf]/\sigma_{11}[\mathbf{1}sf]$, is preferably in the range of 1.2 to 4.5, particularly 3.0 to 4.0, for the purpose of enhancing the toughness of the sintered cermet 6.

Third Embodiment

Figure 6:
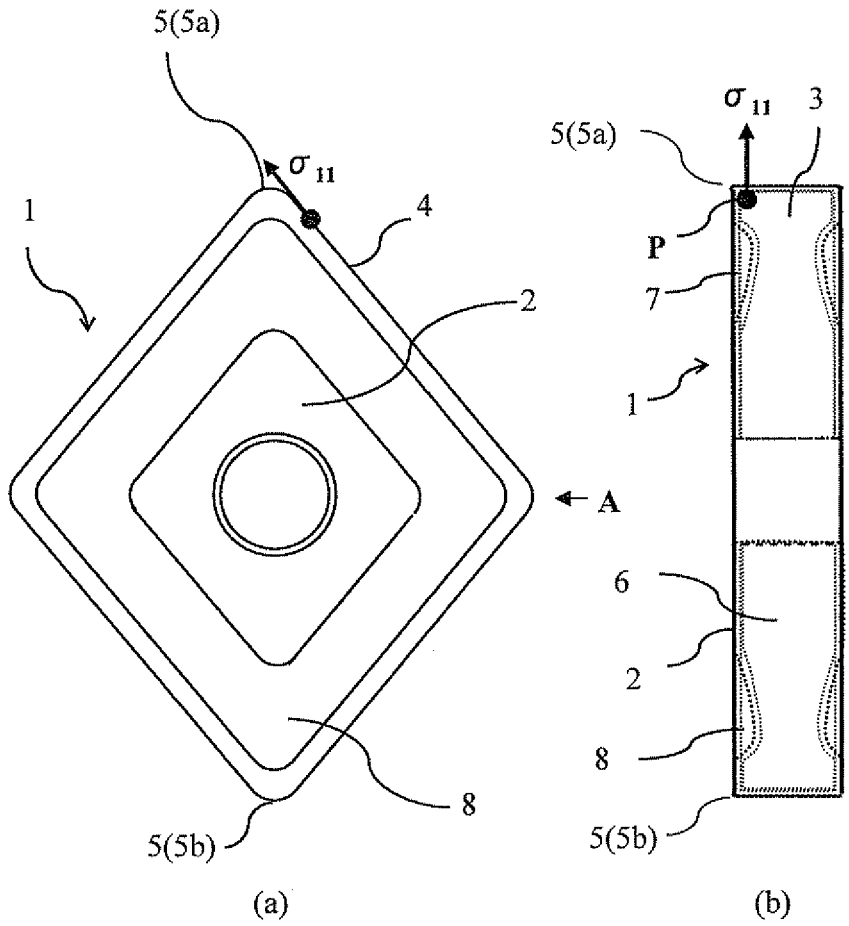
FIG. 6(*a*) is a schematic top view of a throw-away tip as an example of a third embodiment of the cutting tool of the present invention.

A tip 1 of a third embodiment of the present invention has the following structure. That is, as shown in FIGS. 6(*a*) and 6(*b*), the sintered cermet 6 is used as a base. As a coating layer 7, known hard films such as TiN, TiCN, TiAlN, $Al_2O_3$, or the like is formed on the surface of the base by using any known method such as physical vapor deposition (PVD method), chemical vapor deposition (CVD method), or the like.

According to the present invention, when a residual stress is measured on the flank face 3 by the 2D method, the residual stress ($\sigma_{11}[\mathbf{2}cf]$) in a direction ($\sigma_{11}$ direction), which is parallel to the rake face 2 of the second hard phase 13 and is an in-plane direction of the flank face 3, is in the range of 200 MPa or above ($\sigma_{11}[\mathbf{2}cf]\leq-200$ MPa), particularly 200 to 500 MPa, more particularly 200 to 400 MPa in terms of compressive stress. This is 1.1 times or more, particularly 1.1 to 2.0 times, more particularly 1.2 to 1.5 times the residual stress of the second hard phase 13 of the sintered cermet 6 before forming the coating layer 7 in the $\sigma_{11}$ direction. This structure imparts a predetermined compressive stress to the surface of the sintered cermet 6, and thereby improves the thermal shock resistance of the sintered cermet 6. This structure also enhances the hardness of the surface of the sintered cermet 6, and thereby avoids deterioration of the wear resistance thereof. It is therefore capable of improving the thermal shock resistance and fracture resistance of the tip 1.

That is, when the residual stress exerted on the second hard phase 13 of the sintered cermet 6, whose surface is coated with the coating layer 7, is below 200 MPa, the strength and toughness in the surface of the sintered cermet 6 become insufficient, thus lacking in fracture resistance and thermal shock resistance. As a result, the cutting edge 4 is susceptible to fracture and chipping.

When the compressive stress of the second hard phase 13 in the surface of the sintered cermet 6 is below 1.1 times the compressive stress of the second hard phase 13 in the surface region of the sintered cermet 6 which is not coated with the coating layer 7, the residual stress exerted on the sintered cermet 6 is insufficient, thereby to make it difficult to obtain the effect that these two hard phases 11 prevent the crack propagation, failing to obtain sufficient thermal shock resistance and fracture resistance.

Figure 7:
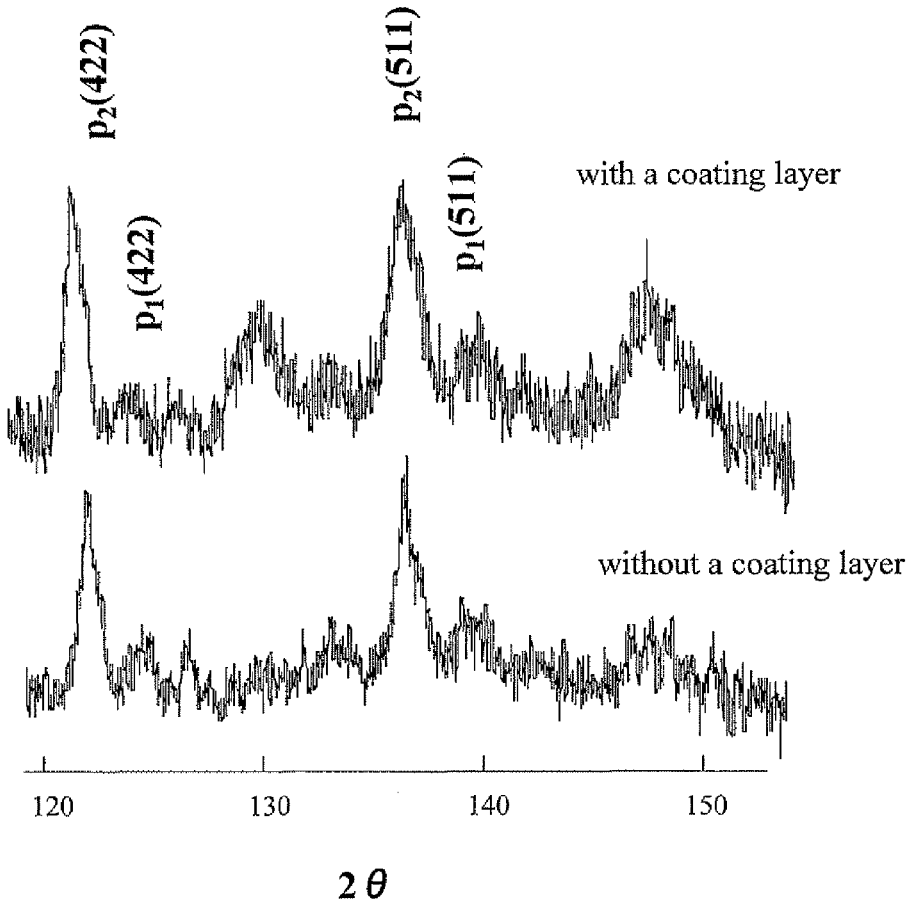
FIG. 7 is an example of X-ray diffraction charts of the throw-away tip where the coating layer is formed on the surface, measured in a part of the flank face where the coating layer is formed and a part of the flank face where the coating layer is not formed.

In the present embodiment, the residual stress is measured at the position P of the flank face 3 immediately below the cutting edge 4, as shown in FIGS. 6(*a*) and 6(*b*). The measurement of the residual stress is carried out similarly to the second embodiment. FIGS. 6(*a*) and 6(*b*) show the measuring position of the residual stress in the present embodiment. FIG. 7 shows an example of the X-ray diffraction peaks used for measuring the residual stress.

In the tip 1 of the present invention, the surface of the sintered cermet 6 is coated with a known hard film such as TiN, TiCN, TiAlN, $Al_2O_3$, or the like. The hard film is preferably formed by using physical vapor deposition method (PVD method). A specific kind of the hard film comprises $Ti_{1-a-b-c-d}Al_aW_bSi_cM_d(C_xN_{1-x})$ where M is one or more selected from among Nb, Mo, Ta, Hf, and Y, $0.45\leq a\leq 0.55$, $0.01\leq b\leq 0.1$, $1.0\leq c\leq 0.05$, $0\leq d\leq 0.1$, and $0\leq x\leq 1$. This is suitable for achieving an optimum range of the residual stress in the surface of the sintered cermet 6, and achieving the high hardness and improved wear resistance of the coating layer 7 itself.

Although all the foregoing embodiments have taken for example the flat plate-shaped throw-away tip tools of the negative tip shape which can be used by turning the rake face and the seating surface upside down, the tools of the present invention are also applicable to throw-away tips of positive tip shape, or rotary tools having a rotary shaft, such as grooving tools, end mills, and drills.

Manufacturing Method

Next, several examples of the method of manufacturing the cermet are described.

Firstly, a mixed powder is prepared by mixing TiCN powder having a mean particle diameter of 0.1 to 2 μm, preferably 0.2 to 1.2 μm, VC powder having a mean particle diameter of 0.1 to 2 μm, any one of carbide powders, nitride powders and carbonitride powders of other metals described above having a mean particle diameter of 0.1 to 2 μm, Co powder having a mean particle diameter of 0.8 to 2.0 μm, Ni powder having a mean particle diameter of 0.5 to 2.0 μm, and when required, $MnCO_3$ powder having a mean particle diameter of 0.5 to 10 μm. In some cases, TiC powder and TiN powder are added to a raw material. These raw powders constitute TiCN in the fired cermet.

Then, a binder is added to the mixed powder. This mixture is then molded into a predetermined shape by a known molding method, such as press molding, extrusion molding, injection molding, or the like. According to the present invention, this mixture is sintered under the following conditions, thereby manufacturing the cermet of the predetermined structure.

The sintering conditions according to a first embodiment employs a sintering pattern in which the following steps (a) to (g) are carried out sequentially:

(a) the step of increasing temperature in vacuum from room temperature to 1200° C.;

(b) the step of increasing temperature in vacuum from 1200° C. to a sintering temperature of 1330 to 1380° C. (referred to as temperature $T_1$) at a heating rate $r_1$ of 0.1 to 2° C./min;

(c) the step of increasing temperature from temperature $T_1$ to a sintering temperature of 1450 to 1600° C. (referred to as temperature $T_2$) at a heating rate $r_2$ of 4 to 15° C./min by changing the atmosphere within a sintering furnace to an inert gas atmosphere of 30 to 2000 Pa at the temperature $T_1$;

(d) the step of holding at the temperature $T_2$ for 0.3 to 2 hours in the inert gas atmosphere of 30 to 2000 Pa;

(e) the step of further holding 30 to 90 minutes by changing the atmosphere within the furnace to vacuum while holding the sintering temperature;

(f) the step of vacuum cooling from the temperature $T_2$ to 1100° C. at a cooling rate of 3 to 15° C./min in a vacuum atmosphere having a degree of vacuum of 0.1 to 3 Pa; and (g) the step of rapid cooling by admitting an inert gas at a gas pressure of 0.1 kPa to 0.9 kPa when the temperature is lowered to 1100° C.

With regard to these sintering conditions, when the heating rate $r_1$ is higher than 2° C./min in the step (b), voids occur in the surface of the cermet. When the heating rate $r_1$ is lower than 0.1° C./min, the sintering time becomes extremely long, and productivity is considerably deteriorated. When the increasing temperature from the temperature $T_1$ in the step (c) is carried out in vacuum or a low pressure gas atmosphere of 30 Pa or below, surface voids occur. When all the holding of the sintering temperature at the temperature $T_2$ in the steps (d) and (e) is carried out in vacuum or a low pressure gas atmosphere of 30 Pa or below, or when all the holding of the sintering temperature at the temperature $T_2$ is carried out in an inert gas atmosphere at a gas pressure of 30 Pa or above, or when the entire cooling process in the steps (f) and (g) is carried out in vacuum or a low pressure gas atmosphere of 30 Pa or below, the residual stress of the hard phases cannot be controlled. When the holding time in the step (e) is shorter than 30 minutes, the residual stress of the sintered cermet 6 cannot be controlled within a predetermined range. When the cooling rate in the step (f) is higher than 15° C./min, the residual stress becomes extremely high, and tensile stress occurs between the two hard phases. When the cooling rate in the step (f) is lower than 3° C./min, the residual stress becomes low, and the effect of improving toughness is deteriorated. When the degree of vacuum in the step (f) is beyond the range of 0.1 to 3 Pa, the solid solution states of the first hard phase 12 and the second hard phase 13 are changed, failing to control the residual stress within the predetermined range.

Under the sintering conditions according to a second embodiment, sintering is carried out using the following sintering pattern. That is, the steps (a) to (g) in the first embodiment are carried out sequentially, followed by the step (h) in which after reincreasing the temperature to a range of 1100 to 1300° C. at a heating rate of 10 to 20° C./min, a pressurized atmosphere is established and held for 30 to 90 minutes by admitting an inert gas at 0.1 to 0.8 kPa, and is thereafter cooled to room temperature at 20 to 60° C./min.

With regard to these sintering conditions, when the conditions in these steps (a) to (f) are not satisfied, the same disadvantageous as the first embodiment occur. Additionally, when the sintered cermet 6 is sintered without passing through the step (h), or without satisfying the predetermined conditions in the step (h), the residual stress cannot be controlled within the predetermined range.

Under the sintering conditions according to a third embodiment, sintering is carried out using the following sintering pattern in which the steps (a) to (f) in the first embodiment are carried out sequentially.

The main surface of the sintered cermet manufactured by the above method is, if desired, subjected to grinding (double-head grinding) by a diamond grinding wheel, a grinding wheel using SiC abrasive grains. Further, if desired, the side surface of the sintered cermet 6 is machined, and the cutting edge is honed by barreling, brushing, blasting, or the like. In the case of forming the coating layer 7, if desired, the surface of the sintered body 6 prior to forming the coating layer may be subjected to cleaning, or the like.

The step of forming the coating layer 7 on the surface of the manufactured sintered cermet in the third embodiment is described below.

Although chemical vapor deposition (CVD) method may be employed as the method of forming the coating layer 7, physical vapor deposition (PVD) methods, such as ion plating method and sputtering method, are suitably employed. The following is the details of a specific example of the method for forming the coating layer. When a coating layer A is formed by ion plating method, individual metal targets respectively containing titanium metal (Ti), aluminum metal (Al), tungsten metal (W), silicon metal (Si), metal M (M is one or more kinds of metals selected from among Nb, Mo, Ta, Hf, and Y), or alternatively a composited alloy target containing these metals is used, and the coating layer is formed by evaporating and ionizing the metal sources by means of arc discharge or glow discharge, and at the same time, by allowing them to react with nitrogen ($N_2$) gas as nitrogen source, and methane ($CH_4$)/acetylene ($C_sH_2$) gas as carbon source.

On this occasion, as a pretreatment for forming the coating layer 7, bombardment treatment is carried out in which, by applying a high bias voltage, particles such as Ar ions are scattered from the evaporation source, such as Ar gas, to the sintered cermet so as to bombard them onto the surface of the sintered cermet 6.

As specific conditions suitable for the bombardment treatment in the present invention, for example, firstly in a PVD furnace for ion plating, arc ion plating, or the like, a tungsten filament is heated by using an evaporation source, thereby bringing the furnace interior into the plasma state of the evaporation source. Thereafter, the bombardment is carried out under the following conditions: furnace internal pressure 0.5 to 6 Pa; furnace internal temperature 400 to 600° C.; and treatment time 2 to 240 minutes. Hereat, in the present invention, a predetermined residual stress can be imparted to each of the first hard phase 12 and the second hard phase 13 in the hard phases 11 of the sintered cermet 6 of the tip 1 by applying the bombardment treatment using Ar gas or Ti metal to the sintered cermet at −600 to −1000 V being higher than the normal bias voltage of −400 to −500 V.

Thereafter, the coating layer 7 is formed by ion plating method or sputtering method. As specific forming conditions, for example, when using ion plating method, the temperature is preferably set at 200 to 600° C., and a bias voltage of 30 to 200V is preferably applied in order to manufacture the high hardness coating layer by controlling the crystal structure and orientation of the coating layer, and in order to enhance the adhesion between the coating layer and the base.

EXAMPLE 1

A mixed powder was prepared by mixing TiCN powder with a mean particle diameter ($d_{50}$ value) of 0.6 μm, WC powder with a mean particle diameter of 1.1 μm, TiN powder with a mean particle diameter of 1.5 μm, VC powder with a mean particle diameter of 1.0 μm, TaC powder with a mean particle diameter of 2 μm, MoC powder with a mean particle diameter of 1.5 μm, NbC powder with a mean particle diameter of 1.5 μm, ZrC powder with a mean particle diameter of 1.8 μm, Ni powder with a mean particle diameter of 2.4 μm, Co powder with a mean particle diameter of 1.9 μm, and $MnCO_3$ powder with a mean particle diameter of 5.0 μm in proportions shown in Table 1. The respective mean particle diameters were measured by micro track method. Using a stainless steel ball mill and cemented carbide balls, the mixed powder was wet mixed with isopropyl alcohol (IPA) and then mixed with 3% by mass of paraffin.

Thereafter, the resulting mixture was press-molded into a throw-away tip tool shape of CNMG120408 at a pressurized pressure of 200 MPa, and was then treated through the following steps:

(a) increasing temperature from room temperature to 1200° C. at 10° C./min in vacuum having a degree of vacuum of 10 Pa;

(b) continuously increasing temperature from 1200° C. to 1350° C. (a sintering temperature $T_1$) at a heating rate $r_1$ of 0.8° C./min in vacuum having a degree of vacuum of 10 Pa;

(c) increasing temperature from 1350° C. (the temperature $T_1$) to a sintering temperature $T_2$ shown in Table 2 at a heating rate $r_2$ shown in Table 2 in a sintering atmosphere shown in Table 2;

(d) holding at the sintering temperature $T_2$ in a sintering atmosphere shown in Table 2 for a sintering time $t_1$;

(e) holding at the sintering temperature $T_2$ in a sintering atmosphere shown in Table 2 for a sintering time $t_2$;

(f) cooling from the temperature $T_2$ to 1100° C. in an atmosphere and at a cooling rate shown in Table 2; and (g) cooling below 1100° C. in an atmosphere shown in Table 2, thereby obtaining cermet throw-away tips of samples Nos. I-1 to I-15.

TABLE 1

| Sample | Composition of raw materials (mass %) | | | | | | | | | | |
|---|---|---|---|---|---|---|---|---|---|---|---|
| | | | | | | | | | Iron-group metal | | |
| No. | TiCN | TiN | WC | TaC | MoC | NbC | ZrC | VC | Ni | Co | $MnCO_3$ |
| 1 | 48.3 | 12 | 15 | 0 | 0 | 10 | 0.2 | 1.5 | 4 | 8 | 1 |
| 2 | 51.8 | 12 | 18 | 1 | 0 | 0 | 0.2 | 2.0 | 5 | 10 | 0 |
| 3 | 51.3 | 6 | 8 | 2 | 5 | 8 | 0.2 | 2.0 | 8 | 8 | 1.5 |
| 4 | 61.1 | 3 | 12 | 0 | 0 | 12 | 0.3 | 1.6 | 2 | 7 | 1 |
| 5 | 49.9 | 12 | 15 | 0 | 0 | 9 | 0.2 | 1.9 | 3.5 | 7.5 | 1 |
| 6 | 49.3 | 10 | 15 | 0 | 2 | 10 | 0.3 | 1.9 | 3 | 8 | 0.5 |
| *7 | 47.8 | 12 | 16 | 0 | 0 | 10 | 0.2 | 1.0 | 4 | 7.5 | 1.5 |
| *8 | 47.4 | 12 | 16 | 0 | 0 | 10 | 0.2 | 2.4 | 3 | 8 | 1 |
| *9 | 49.0 | 8 | 18 | 3 | 0 | 11 | 1.0 | 0 | 3 | 7 | 0 |
| *10 | 44.5 | 12 | 18 | 3 | 0 | 11 | 1.0 | 3.0 | 1 | 6 | 0.5 |
| *11 | 53.3 | 4 | 18 | 0 | 2 | 10 | 0.5 | 0.7 | 5 | 5.5 | 1 |
| *12 | 52.9 | 12 | 14 | 3 | 0 | 8 | 0.1 | 2.0 | 2 | 6 | 0 |
| *13 | 47.8 | 8 | 14 | 3 | 0 | 8 | 0.2 | 2.0 | 4 | 12 | 1 |
| *14 | 56.9 | 5 | 15 | 1 | 1 | 9 | 0.3 | 1.3 | 3 | 7 | 0.5 |
| *15 | 51.3 | 10 | 11 | 1 | 1 | 9 | 0.2 | 1.5 | 4 | 10 | 1 |

Asterisk (*) indicates sample out of range of present invention

TABLE 2

| | Sintering condition | | | | | | | | | | | | |
|---|---|---|---|---|---|---|---|---|---|---|---|---|---|
| | | Step (c) | | | | | | Step (e) | | Step (f) | | | |
| | | Heating | | | | Step (d) | | Sin- | Sin- | Cooling | | | |
| Sample No. | Step (b) Sintering atmosphere | rate $r_2$ (° C./minute) | Sintering temperature $T_2$ (° C.) | Sintering atmosphere | Sintering atmosphere | Sintering time $t_1$ (hour) | tering atmosphere | tering time $t_2$ (hour) | rate $r_3$ (° C./minute) | Firing atmosphere | Step (g) Sintering atmosphere | |
| 1 | vacuum | 13 | 1525 | $N_2$ 1000 Pa | $N_2$ 600 Pa | 0.6 | vacuum | 1.1 | 4 | vacuum (degree of vacuum of 2.5 Pa) | $N_2$ | 200 Pa |
| 2 | vacuum | 8 | 1450 | Ar 100 Pa | Ar 110 Pa | 0.6 | vacuum | 1.4 | 7 | vacuum (degree of vacuum of 1.0 Pa) | Ar | 800 Pa |
| 3 | vacuum | 7 | 1525 | $N_2$ 500 Pa | $N_2$ 900 Pa | 0.6 | vacuum | 1.0 | 8 | vacuum (degree of vacuum of 3.0 Pa) | $N_2$ | 100 Pa |

TABLE 2-continued

| | Sintering condition | | | | | | | | | | | |
|---|---|---|---|---|---|---|---|---|---|---|---|---|
| | | Step (c) | | | | | Step (e) | | Step (f) | | | |
| | | Heating | | | Step (d) | | Sin- | Sin- | Cooling | | | |
| Sample No. | Step (b) Sintering atmosphere | rate $r_2$ (° C./minute) | Sintering temperature $T_2$ (° C.) | Sintering atmosphere | Sintering atmosphere | Sintering time $t_1$ (hour) | tering atmosphere | tering time $t_2$ (hour) | rate $r_3$ (° C./minute) | Firing atmosphere | Step (g) Sintering atmosphere |
| 4 | vacuum | 10 | 1575 | $N_2$ 1500 Pa | $N_2$ 1100 Pa | 1.1 | vacuum | 1.5 | 9 | vacuum (degree of vacuum of 0.3 Pa) | $N_2$ 700 Pa |
| 5 | vacuum | 7 | 1575 | $N_2$ 1000 Pa | $N_2$ 1100 Pa | 1.1 | vacuum | 1.3 | 9 | vacuum (degree of vacuum of 0.8 Pa) | $N_2$ 700 Pa |
| 6 | vacuum | 9 | 1550 | $N_2$ 700 Pa | $N_2$ 400 Pa | 0.3 | vacuum | 1.2 | 3 | vacuum (degree of vacuum of 1.5 Pa) | $N_2$ 800 Pa |
| *7 | vacuum | 8 | 1550 | $N_2$ 1000 Pa | $N_2$ 800 Pa | 0.6 | vacuum | 0.4 | 16 | vacuum (degree of vacuum of 1.0 Pa) | $N_2$ 800 Pa |
| *8 | vacuum | 7 | 1575 | $N_2$ 2000 Pa | $N_2$ 1000 Pa | 0.6 | vacuum | 0.6 | 9 | vacuum (degree of vacuum of 10 Pa) | $N_2$ 700 Pa |
| *9 | vacuum | 5 | 1525 | $N_2$ 900 Pa | $N_2$ 3000 Pa | 1.1 | vacuum | 1.1 | 8 | vacuum (degree of vacuum of 1.5 Pa) | $N_2$ 700 Pa |
| *10 | vacuum | 8 | 1400 | $N_2$ 800 Pa | $N_2$ 200 Pa | 0.6 | vacuum | 0.6 | 11 | vacuum (degree of vacuum of 0.5 Pa) | $N_2$ 300 Pa |
| *11 | vacuum | 8 | 1650 | $N_2$ 2000 Pa | $N_2$ 900 Pa | 0.4 | vacuum | 0.6 | 8 | vacuum (degree of vacuum of 1.0 Pa) | $N_2$ 500 Pa |
| *12 | $N_2$ 800 Pa | 7 | 1525 | $N_2$ 5000 Pa | $N_2$ 1100 Pa | 1.2 | vacuum | 0.6 | 9 | vacuum (degree of vacuum of 1.0 Pa) | $N_2$ 700 Pa |
| *13 | vacuum | 5 | 1550 | He 1200 Pa | He 1300 Pa | 0.9 | vacuum | 1.2 | 21 | vacuum (degree of vacuum of 1.5 Pa) | $N_2$ 500 Pa |
| *14 | $N_2$ 800 Pa | 7 | 1575 | V — | $N_2$ 900 Pa | 0.9 | — | | 9 | $N_2$ 800 Pa | $N_2$ 800 Pa |
| *15 | $N_2$ 800 Pa | 12 | 1550 | $N_2$ 800 Pa | — | | vacuum | 1.2 | 8 | vacuum (degree of vacuum of 2.0 Pa) | vacuum |

Asterisk (*) indicates sample out of range of present invention

After the rake face of each of the obtained cermets was ground 0.5 mm thickness into a mirror surface, the residual stresses of the first hard phase and the second hard phase were measured by the 2D method (apparatus: X-ray diffraction instrument manufactured by Bruker AXS, D8 DISCOVER with GADDS Super Speed; radiation source: $CuK_\alpha$; collimator diameter: 0.3 mmΦ; measuring diffraction line: TiN (422) plane). The results were shown in Table 4.

Further, each of these samples was observed using a scanning electron microscope (SEM), and a photograph thereof was taken at 10000 times magnification. With respect to optional five locations in the interior of the sample, the image analyses of their respective regions of 8 μm×8 μm were carried out using a commercially available image analysis software, and the mean particle diameters of the first hard phase and the second hard phase, and their respective content ratios were calculated. As the results of the structure observations of these samples, it was confirmed that the hard phases with the core-containing structure, in which the second hard phase surrounded the periphery of the first hard phase, existed in every sample. The results were shown in Table 3.

TABLE 3

| | Hard phase | | | | | | |
|---|---|---|---|---|---|---|---|
| Sample No. | d (μm) | $d_{1i}$ (μm) | $d_{2i}$ (μm) | $d_{2i}/d_{1i}$ | $S_{1i}$ (area %) | $S_{2i}$ (area %) | $S_{2i}/S_{1i}$ |
| 1 | 0.45 | 0.29 | 1.24 | 4.28 | 27.5 | 72.5 | 2.64 |
| 2 | 0.73 | 0.43 | 1.78 | 4.14 | 35.5 | 64.5 | 1.82 |
| 3 | 0.47 | 0.35 | 1.33 | 3.80 | 40.1 | 59.9 | 1.49 |
| 4 | 0.87 | 0.35 | 1.91 | 5.46 | 15.4 | 84.6 | 5.49 |
| 5 | 0.51 | 0.32 | 1.52 | 4.75 | 35.5 | 64.5 | 1.82 |
| 6 | 0.80 | 0.38 | 1.43 | 3.76 | 25.0 | 75.0 | 3.00 |
| *7 | 1.35 | 0.21 | 2.10 | 10.00 | 39.5 | 60.5 | 1.53 |
| *8 | 0.63 | 0.48 | 1.52 | 3.17 | 28.5 | 71.5 | 2.51 |

TABLE 3-continued

| | Hard phase | | | | | | |
|---|---|---|---|---|---|---|---|
| Sample No. | d (μm) | $d_{1i}$ (μm) | $d_{2i}$ (μm) | $d_{2i}/d_{1i}$ | $S_{1i}$ (area %) | $S_{2i}$ (area %) | $S_{2i}/S_{1i}$ |
| *9 | 0.74 | 0.43 | 1.38 | 3.21 | 45.3 | 54.7 | 1.21 |
| *10 | 0.63 | 0.35 | 1.41 | 4.03 | 52.2 | 47.8 | 0.92 |
| *11 | 0.84 | 0.51 | 1.91 | 3.75 | 27.0 | 73.0 | 2.70 |
| *12 | 0.43 | 0.26 | 1.65 | 6.35 | 38.0 | 62.0 | 1.63 |
| *13 | 0.38 | 0.28 | 1.29 | 4.61 | 35.5 | 64.5 | 1.82 |
| *14 | 0.35 | 0.26 | 1.34 | 5.15 | 12.0 | 88.0 | 7.33 |
| *15 | 0.33 | 0.25 | 1.34 | 5.36 | 38.2 | 61.8 | 1.62 |

Asterisk (*) indicates sample out of range of present invention

Using the obtained cutting tools made of the cermets, cutting tests were conducted under the following cutting conditions. The results were shown together in Table 4.

(Wear Resistance Evaluation)

Work material: SCM435

Cutting speed: 200 m/min

Feed rate: 0.20 mm/rev

Depth of cut: 1.0 mm

Cutting state: wet (using water-soluble cutting fluid)

Evaluation method: time elapsed until the amount of wear reached 0.2 mm (Fracture Resistance Evaluation)

Work material: S45C

Cutting speed: 120 m/min

Feed rate: 0.05 mm/rev or more

Depth of cut: 1.5 mm

Cutting state: dry

Evaluation method: time (sec) elapsed until fracture occurred by each feed rate 10 S.

TABLE 4

| Sample No. | Residual stress σ11 $\sigma_{11}$[1r] (MPa) | $\sigma_{11}$[2r] (MPa) | $\sigma_{11}$[2rA] (MPa) | $\sigma_{11}$[2rB] (MPa) | $\sigma_{11}$[1r]/$\sigma_{11}$[2r] | Residual stress σ22 $\sigma_{22}$[1r] (MPa) | $\sigma_{22}$[2r] (MPa) | Core-containing structure | Cutting performance Fracture resistance (second) | Wear resistance (minute) |
|---|---|---|---|---|---|---|---|---|---|---|
| 1 | −49 | −311 | −298 | −426 | 0.16 | −136 | −634 | Without | 80 | 115 |
| 2 | −46 | −161 | −172 | −268 | 0.29 | −70 | −198 | With | 75 | 104 |
| 3 | −11 | −151 | −115 | −265 | 0.07 | −55 | −424 | With | 69 | 101 |
| 4 | −11 | −420 | −400 | −500 | 0.03 | −181 | −188 | With | 73 | 97 |
| 5 | −39 | −201 | −185 | −410 | 0.19 | −96 | −310 | With | 96 | 145 |
| 6 | −29 | −240 | −210 | −390 | 0.12 | −89 | −429 | With | 83 | 130 |
| *7 | −65 | −135 | −125 | −110 | 0.48 | −115 | −256 | With | 63 | 70 |
| *8 | −48 | −140 | −124 | −115 | 0.34 | −88 | −354 | With | 58 | 86 |
| *9 | −75 | −155 | −172 | −347 | 0.48 | −45 | −264 | With | 57 | 73 |
| *10 | −72 | −120 | −106 | −141 | 0.60 | −198 | −642 | Without | 53 | 75 |
| *11 | 15 | −201 | −185 | −294 | −0.07 | −168 | −198 | With | 50 | 58 |
| *12 | −69 | −109 | −121 | −145 | 0.63 | −202 | −185 | Without | 48 | 65 |
| *13 | 10 | −52 | −71 | −132 | −0.19 | 0 | −103 | Without | 48 | 80 |
| *14 | 2 | −252 | −221 | −310 | −0.008 | −8 | −225 | Without | 47 | 58 |
| *15 | −46 | −128 | −115 | −139 | 0.36 | −201 | −271 | With | 38 | 89 |

Asterisk (*) indicates sample out of range of present invention

The followings were noted from Tables 1 to 4. That is, in the sample Nos. I-7 to I-15 having the residual stress beyond the range of the present invention, the toughness of the tool was insufficient, and the chipping of the cutting edge and the sudden fracture of the cutting edge occurred early, failing to obtain a sufficient tool life. On the contrary, the sample Nos. I-1 to I-6 within the range of the present invention had high toughness, and therefore no chipping of the cutting edge occurred, thus exhibiting an excellent tool life.

EXAMPLE 2

The raw materials of Example 1 were mixed into compositions in Table 5, and were molded similarly to Example 1. This was then treated through the following steps:

(a) increasing temperature from room temperature to 1200° C. at 10° C./min in vacuum having a degree of vacuum of 10 Pa;

(b) continuously increasing temperature from 1200° C. to 1300° C. (a sintering temperature $T_1$) at a heating rate $r_1$ of 0.8° C./min in vacuum having a degree of vacuum of 10 Pa;

(c) increasing temperature from 1350° C. (the temperature $T_1$) to a sintering temperature $T_2$ shown in Table 2 at a heating rate $r_2$ of 7° C./min in a sintering atmosphere shown in Table 6;

(d) holding at the sintering temperature $T_2$ in the same sintering atmosphere as the step (c) for a sintering time $t_1$ of Table 2;

(e) holding at the sintering temperature $T_2$ in vacuum having a degree of vacuum of 10 Pa for a sintering time $t_2$ shown in Table 2;

(f) cooling from the temperature $T_2$ to 1100° C. in an atmosphere of Ar gas of 0.8 kPa at a cooling rate of 8° C./min;

(g) cooling from 1100° C. to 800° C. in the same sintering atmosphere in an atmosphere shown in Table 6; and (h) reincreasing temperature process in which temperature was increased up to 1300° C. in a sintering atmosphere shown in Table 2 at 12° C./min, and was held for a hold time shown in Table 6, and the temperature is decreased up to 500° C. or below at a cooling rate in Table 6, thereby obtaining cermet throw-away tips of samples Nos. II-1 to II-13.

TABLE 5

| Sample No. | Composition of raw materials (mass %) TiCN | TiN | WC | TaC | MoC | NbC | ZrC | VC | Ni | Co | $MnCO_3$ |
|---|---|---|---|---|---|---|---|---|---|---|---|
| 1 | 48.3 | 12 | 15 | 0 | 0 | 10 | 0.2 | 1.5 | 4 | 8 | 1 |
| 2 | 51.8 | 12 | 18 | 1 | 0 | 0 | 0.2 | 2.0 | 5 | 10 | 0 |
| 3 | 51.3 | 6 | 12 | 0 | 5 | 8 | 0.2 | 2.0 | 6 | 8 | 1.5 |
| 4 | 61.1 | 3 | 12 | 0 | 0 | 12 | 0.3 | 1.6 | 2 | 7 | 1 |
| 5 | 49.9 | 12 | 15 | 0 | 0 | 9 | 0.2 | 1.9 | 3.5 | 7.5 | 1 |
| 6 | 49.3 | 10 | 15 | 0 | 2 | 10 | 0.3 | 1.9 | 3 | 8 | 0.5 |
| *7 | 47.8 | 12 | 16 | 0 | 0 | 10 | 0.2 | 1.0 | 4 | 7.5 | 1.5 |
| *8 | 47.4 | 12 | 16 | 0 | 0 | 10 | 0.2 | 2.4 | 3 | 8 | 1 |
| *9 | 49.0 | 8 | 18 | 3 | 0 | 11 | 1.0 | 0.0 | 3 | 7 | 0 |
| *10 | 52.9 | 12 | 14 | 3 | 0 | 8 | 0.1 | 2.0 | 2 | 6 | 0 |
| *11 | 47.8 | 8 | 14 | 3 | 0 | 8 | 0.2 | 2.0 | 4 | 12 | 1 |
| *12 | 56.9 | 5 | 15 | 1 | 1 | 9 | 0.3 | 1.3 | 3 | 7 | 0.5 |
| *13 | 51.3 | 10 | 11 | 1 | 1 | 9 | 0.2 | 1.5 | 4 | 10 | 1 |

Asterisk (*) indicates sample out of range of present invention

TABLE 6

| | Step (c) | | | Step (d) | Step (e) | | | | |
|---|---|---|---|---|---|---|---|---|---|
| | Sintering | | | Sintering | Sintering | Step (h) | | | |
| Sample No | temperature $T_2$ (° C.) | Sintering atmosphere | | time $t_1$ (hour) | time $t_2$ (hour) | Sintering atmosphere | | Hold time (min.) | Cooling rate (° C./minute) |
| 1 | 1525 | $N_2$ | 1000 Pa | 0.6 | 1.1 | $N_2$ | 200 Pa | 45 | 20 |
| 2 | 1450 | Ar | 100 Pa | 0.6 | 1.4 | Ar | 800 Pa | 30 | 35 |
| 3 | 1550 | $N_2$ | 800 Pa | 0.6 | 1.0 | $N_2$ | 300 Pa | 60 | 40 |
| 4 | 1575 | $N_2$ | 1500 Pa | 1.1 | 1.5 | $N_2$ | 700 Pa | 45 | 53 |
| 5 | 1575 | $N_2$ | 1000 Pa | 1.1 | 1.3 | $N_2$ | 700 Pa | 45 | 43 |
| 6 | 1550 | $N_2$ | 1000 Pa | 0.3 | 1.2 | $N_2$ | 800 Pa | 90 | 60 |
| *7 | 1550 | $N_2$ | 1000 Pa | 0.6 | 0.4 | — | — | — | — |
| *8 | 1575 | vacuum | — | 0.6 | 0.6 | $N_2$ | 700 Pa | 45 | 45 |
| *9 | 1525 | $N_2$ | 800 Pa | 1.1 | 1.1 | vacuum | | 60 | 45 |
| *10 | 1525 | $N_2$ | 500 Pa | 1.2 | 0.6 | $N_2$ | 700 Pa | 120 | 35 |
| *11 | 1550 | He | 1000 Pa | 0.9 | 1.2 | $N_2$ | 800 Pa | 60 | 100 |
| *12 | 1575 | $N_2$ | 1000 Pa | 0.9 | | $N_2$ | 200 Pa | 60 | 1 |
| *13 | 1575 | $N_2$ | 800 Pa | 1.1 | 1.5 | $N_2$ | 700 Pa | 60 | 35 |

Asterisk (*) indicates sample out of range of present invention

After the rake face of each of the obtained cermets was ground 0.5 mm thickness into a mirror surface, the residual stresses of the first hard phase and the second hard phase were measured by using the same 2D method as Example 1. Under the same conditions as Example 1, the mean particle diameters of the first hard phase and the second hard phase, and their respective content ratios were calculated. As the results of the structure observations of these samples, it was confirmed that the hard phases with core-containing structure, in which the second hard phase surrounded the periphery of the first hard phase, existed in every sample. The results were shown in Tables 7 and 8.

TABLE 7

| | Sintered body (interior) | | | | | |
|---|---|---|---|---|---|---|
| Sample No. | $d_{1i}$ (μm) | $d_{2i}$ (μm) | $d_{2i}/d_{1i}$ | $S_{1i}$ (area %) | $S_{2i}$ (area %) | $S_{2i}/S_{1i}$ |
| 1 | 0.31 | 1.24 | 4.00 | 52.4 | 47.6 | 0.91 |
| 2 | 0.38 | 1.91 | 5.03 | 44.6 | 55.4 | 1.24 |
| 3 | 0.35 | 1.48 | 4.23 | 49.3 | 50.7 | 1.03 |
| 4 | 0.29 | 0.78 | 2.69 | 74.6 | 25.4 | 0.34 |
| 5 | 0.36 | 1.73 | 4.81 | 54.5 | 45.5 | 0.83 |
| 6 | 0.38 | 1.43 | 3.76 | 49.0 | 51.0 | 1.04 |
| *7 | 0.34 | 1.32 | 3.88 | 50.5 | 49.5 | 0.98 |
| *8 | 0.48 | 1.52 | 3.17 | 41.5 | 58.5 | 1.41 |
| *9 | 0.33 | 1.38 | 4.18 | 48.7 | 51.3 | 1.05 |
| *10 | 0.36 | 1.19 | 3.31 | 50.5 | 49.5 | 0.98 |
| *11 | 0.38 | 1.29 | 3.39 | 48.5 | 51.5 | 1.06 |
| *12 | 0.42 | 1.64 | 3.90 | 38.0 | 62.0 | 1.63 |
| *13 | 0.39 | 1.86 | 4.77 | 41.8 | 58.2 | 1.39 |

Asterisk (*) indicates sample out of range of present invention

TABLE 8

| | Sintered body (surface) | | | | | | |
|---|---|---|---|---|---|---|---|
| Sample No. | $d_{1s}$ (μm) | $d_{2s}$ (μm) | $d_{2s}/d_{1s}$ | $S_{1s}$ (area %) | $S_{2s}$ (area %) | $S_{2s}/S_{1s}$ | $S_{2s}/S_{2i}$ |
| 1 | 0.30 | 1.39 | 4.63 | 16.8 | 83.2 | 4.95 | 1.75 |
| 2 | 0.39 | 2.25 | 5.77 | 10.3 | 89.7 | 8.71 | 1.62 |
| 3 | 0.35 | 1.45 | 4.14 | 24.6 | 75.4 | 3.07 | 1.49 |

TABLE 8-continued

| | Sintered body (surface) | | | | | | |
|---|---|---|---|---|---|---|---|
| Sample No. | $d_{1s}$ (μm) | $d_{2s}$ (μm) | $d_{2s}/d_{1s}$ | $S_{1s}$ (area %) | $S_{2s}$ (area %) | $S_{2s}/S_{1s}$ | $S_{2s}/S_{2i}$ |
| 4 | 0.36 | 1.21 | 3.36 | 29.1 | 70.9 | 2.44 | 2.79 |
| 5 | 0.34 | 1.94 | 5.71 | 15.2 | 84.8 | 5.58 | 1.86 |
| 6 | 0.32 | 1.53 | 4.78 | 19.5 | 80.5 | 4.13 | 1.58 |
| *7 | 0.20 | 1.46 | 7.30 | 25.3 | 74.7 | 2.95 | 1.51 |
| *8 | 0.45 | 1.71 | 3.80 | 36.8 | 63.2 | 1.72 | 1.08 |
| *9 | 0.42 | 1.44 | 3.43 | 25.8 | 74.2 | 2.88 | 1.45 |
| *10 | 0.29 | 1.25 | 4.31 | 28.9 | 71.1 | 2.46 | 1.44 |
| *11 | 0.29 | 1.32 | 4.55 | 18.8 | 81.2 | 4.32 | 1.58 |
| *12 | 0.31 | 2.06 | 6.65 | 13.5 | 86.5 | 6.41 | 1.40 |
| *13 | 0.26 | 2.12 | 8.15 | 16.2 | 83.8 | 5.17 | 1.44 |

Asterisk (*) indicates sample out of range of present invention

Using the cutting tools made of the obtained cermets, cutting tests were conducted under the following cutting conditions. The results were shown together in Table 9.

(Wear Resistance Evaluation)

Work material: SCM435

Cutting speed: 200 m/min

Feed rate: 0.20 mm/rev

Depth of cut: 1.0 mm

Cutting state: wet (using water-soluble cutting fluid)

Evaluation method: time elapsed until the amount of wear reached 0.2 mm (Fracture Resistance Evaluation)

Work material: SCM435C

Cutting speed: 120 m/min

Feed rate: 0.05 mm/rev or more

Depth of cut: 1.5 mm

Cutting state: dry

Evaluation method: time (sec) elapsed until fracture occurs by each feed rate 10 S.

TABLE 9

| Sample No. | Residual stress $\sigma_{11}$[2if] (MPa) | $\sigma_{11}$[2sf] (MPa) | $\sigma_{11}$[1if] (MPa) | $\sigma_{11}$[1sf]/ (MPa) | $\sigma_{11}$[2sf]/ $\sigma_{11}$[1sf] | Cutting performance Fracture resistance (second) | Water resistance (minute) |
|---|---|---|---|---|---|---|---|
| 1 | −236 | −311 | −35 | −80 | 3.89 | 80 | 115 |
| 2 | −198 | −220 | −42 | −179 | 1.23 | 75 | 104 |
| 3 | −171 | −210 | −68 | −205 | 1.02 | 68 | 100 |
| 4 | −162 | −420 | −77 | −100 | 4.20 | 73 | 97 |
| 5 | −187 | −342 | −26 | −90 | 3.80 | 96 | 145 |
| 6 | −228 | −240 | −55 | −80 | 3.00 | 83 | 130 |
| *7 | −134 | −135 | −73 | −120 | 1.13 | 63 | 70 |
| *8 | −175 | −140 | −61 | −130 | 1.08 | 58 | 86 |
| *9 | −179 | −155 | −33 | −150 | 1.03 | 57 | 73 |
| *10 | −188 | −109 | −28 | −180 | 0.61 | 48 | 65 |
| *11 | −98 | −52 | −11 | −110 | 0.47 | 48 | 80 |
| *12 | −120 | −252 | −43 | −225 | 1.12 | 47 | 58 |
| *13 | −128 | −128 | −120 | −128 | 1.00 | 38 | 89 |

Asterisk (*) indicates sample out of range of present invention

The following were noted from Tables 5 to 9. That is, in the sample No. II-7 sintered without passing through the step (h);

the sample No. II-8 using vacuum as the sintering atmosphere in the step (c);

the sample No. II-9 using vacuum as the sintering atmosphere in the step (h);

the sample No. II-10 setting the holding time in the step (h) so as to be longer than 90 minutes; and the sample No. II-11 setting the cooling rate in the step (h) at more than 60° C./min, their respective $\sigma_{11}$[2*if*] were compressive stresses, but their respective absolute values were smaller than 200 MPa. Therefore, all these samples were poor in both fracture resistance and wear resistance. In the sample No. II-12 setting the cooling rate in the step (h) at less than 30 minutes, the $\sigma_{11}$[2*sf*] was compressive stress, but the absolute value thereof was smaller than 150 MPa, resulting in poor fracture resistance and poor wear resistance. In the sample No. II-13 in which the entire surface of the sintered body was polished and the $\sigma_{11}$[2*sf*] was compressive stress, but the absolute value thereof was smaller than 200 MPa, and the $\sigma_{11}$[2*sf*] and the $\sigma_{11}$[2*if*] were identical to each other, the wear resistance thereof was low.

On the contrary, in the samples Nos. II-1 to II-6 in which the $\sigma_{11}$[2*sf*] was compressive stress and the absolute value thereof was 200 MPa or above ($\sigma_{11}$[2*sf*]≤−200 MPa), and the $\sigma_{11}$[2*if*] was compressive stress, and the absolute value thereof was 150 MPa or above ($\sigma_{11}$[2*if*]≤−150 MPa), their respective wear resistances and fracture resistances were high.

EXAMPLE 3

The raw materials of Example 1 were mixed into compositions in Table 10, and were molded similarly to Example 1. This was then treated through the following steps:

(a) increasing temperature from room temperature to 1200° C. at 10° C./min in vacuum having a degree of vacuum of 10 Pa;

(b) continuously increasing temperature from 1200° C. to 1350° C. (a sintering temperature $T_1$) at a heating rate $r_1$ of 0.8° C./mi in vacuum having the degree of vacuum of 10 Pa n;

(c) increasing temperature from 1350° C. (the temperature $T_1$) to a sintering temperature $T_2$ shown in Table 11 at a heating rate $r_2$ shown in Table 11 in a sintering atmosphere shown in Table 11;

(d) holding at the sintering temperature $T_2$ in a sintering atmosphere shown in Table 11 for a sintering time $t_1$; (e) holding at the sintering temperature $T_2$ in a sintering atmosphere shown in Table 11 for a sintering time $t_2$;

(f) cooling from the temperature $T_2$ to 1100° C. in a vacuum atmosphere having a degree of vacuum of 2.5 Pa at a cooling rate of 15 min/° C.; and (g) cooling from 1100° C. in a nitrogen ($N_2$) atmosphere to 200 Pa, thereby obtaining each sintered cermet.

TABLE 10

| Sample No. | Composition of raw materials (mass %) TiCN | TiN | WC | TaC | MoC | NbC | ZrC | VC | Ni | Co | $MnCO_3$ |
|---|---|---|---|---|---|---|---|---|---|---|---|
| 1 | 48.0 | 12 | 15 | 0 | 0 | 10 | 0.2 | 1.8 | 4 | 8 | 1 |
| 2 | 53.3 | 12 | 18 | 1 | 0 | 0 | 0.2 | 1.5 | 3 | 10 | 1 |
| 3 | 57.8 | 6 | 12 | 0 | 3 | 8 | 0.2 | 1.5 | 2.5 | 7.5 | 1.5 |
| 4 | 54.8 | 3 | 16 | 0 | 0 | 12 | 0.3 | 1.9 | 3 | 8 | 1 |
| 5 | 50.8 | 12 | 15 | 0 | 0 | 9 | 0.2 | 1.5 | 3.5 | 7.5 | 0.5 |
| 6 | 47.8 | 10 | 15 | 0 | 2 | 10 | 0.3 | 1.9 | 3 | 9 | 1 |
| 7 | 53.8 | 10 | 12 | 0 | 3 | 8 | 0.2 | 1.5 | 2.5 | 7.5 | 1.5 |
| *8 | 47.4 | 12 | 16 | 0 | 0 | 10 | 0.2 | 2.4 | 3 | 8 | 1 |
| *9 | 49.5 | 8 | 18 | 3 | 0 | 11 | 0.5 | 0 | 3 | 7 | 0 |
| *10 | 43.0 | 12 | 18 | 3 | 0 | 11 | 0.5 | 2.0 | 2 | 8 | 0.5 |
| *11 | 53.3 | 4 | 18 | 0 | 2 | 10 | 0.5 | 0.7 | 5 | 5.5 | 1 |
| *12 | 54.9 | 12 | 12 | 3 | 0 | 8 | 0.1 | 2.0 | 2 | 6 | 0 |
| *13 | 49.8 | 12 | 12 | 3 | 0 | 8 | 0.2 | 2.0 | 4 | 8 | 1 |

TABLE 10-continued

| Sample | Composition of raw materials (mass %) | | | | | | | | | | |
|---|---|---|---|---|---|---|---|---|---|---|---|
| No. | TiCN | TiN | WC | TaC | MoC | NbC | ZrC | VC | Ni | Co | $MnCO_3$ |
| *14 | 60.9 | 5 | 11 | 1 | 1 | 9 | 0.3 | 1.3 | 3 | 7 | 0.5 |
| *15 | 60.3 | 5 | 11 | 1 | 1 | 9 | 0.2 | 1.5 | 3 | 7 | 1 |

Asterisk (*) indicates sample out of range of present invention

TABLE 11

| | Step (c) | | | | Step (d) | | | Step (e) | | |
|---|---|---|---|---|---|---|---|---|---|---|
| Sample No. | Heating rate $r_2$ (° C./minute) | Sintering temperature $T_2$ (° C.) | Sintering atmosphere | | Sintering atmosphere | | Sintering time $t_1$ (hour) | Sintering atmosphere | Sintering temperature $T_3$ (° C.) | Sintering time $t_2$ (hour) |
| 1 | 13 | 1560 | $N_2$ | 1500 Pa | $N_2$ | 600 Pa | 0.6 | vacuum | 1600 | 0.8 |
| 2 | 8 | 1525 | $N_2$ | 800 Pa | Ar | 110 Pa | 0.6 | vacuum | 1550 | 0.5 |
| 3 | 7 | 1525 | $N_2$ | 1000 Pa | $N_2$ | 900 Pa | 0.5 | vacuum | 1575 | 0.5 |
| 4 | 10 | 1575 | Ar | 1500 Pa | $N_2$ | 1100 Pa | 1.1 | vacuum | 1500 | 1.0 |
| 5 | 7 | 1450 | $N_2$ | 300 Pa | $N_2$ | 1100 Pa | 1.5 | vacuum | 1460 | 0.6 |
| 6 | 9 | 1500 | $N_2$ | 700 Pa | $N_2$ | 400 Pa | 0.8 | vacuum | 1525 | 0.7 |
| 7 | 10 | 1530 | $N_2$ | 1000 Pa | $N_2$ | 1200 Pa | 0.6 | vacuum | 1560 | 0.5 |
| *8 | 7 | 1475 | $N_2$ | 2000 Pa | $N_2$ | 1000 Pa | 0.6 | vacuum | 1500 | 1.0 |
| *9 | 5 | 1450 | $N_2$ | 3000 Pa | $N_2$ | 3000 Pa | 1.5 | vacuum | 1500 | 0.5 |
| *10 | 8 | 1525 | $N_2$ | 800 Pa | $N_2$ | 200 Pa | 0.3 | vacuum | 1575 | 1.5 |
| *11 | 8 | 1550 | $N_2$ | 2000 Pa | $N_2$ | 900 Pa | 0.4 | vacuum | 1575 | 1.0 |
| *12 | 7 | 1525 | $N_2$ | 500 Pa | $N_2$ | 1100 Pa | 0.7 | vacuum | 1535 | 0.5 |
| *13 | 5 | 1525 | He | 1200 Pa | He | 1300 Pa | 0.3 | vacuum | 1575 | 0.3 |
| *14 | 7 | 1550 | vacuum | | $N_2$ | 800 Pa | 0.9 | | — | |
| *15 | 12 | 1500 | $N_2$ | 800 Pa | | — | | vacuum | 1550 | 5.5 |

Asterisk (*) indicates sample out of range of present invention

In each of the obtained cermet sintered bodies, the residual stress ($\sigma_{11}$[2*nf*]) of the second hard phase 13 before forming the coating layer was measured similarly to Example 2. The results were shown in Table 15. Double head grinding; honing process by brushing using diamond abrasive grains, or alternatively, by blasting using alumina abrasive grains; and cleaning using acid, alkaline solution, and distilled water were applied to each of the obtained sintered cermet. Sample No. III-5 was a G class tip with high dimensional precision in which the surface portion of the sintered cermet was removed by applying a grinding process using diamond abrasive grains to the entire surface including the side surface of the sintered cermet.

Subsequently, a coating layer shown in Table 13 was formed on the surface of the obtained sintered cermet by arc ion plating method under coating conditions shown in Table 12, thereby manufacturing cermet tools of samples Nos. III-1 to III-15.

TABLE 12

| Treatment details | Bias voltage (V) | Gas applied | Gas pressure (Pa) | Treatment time (minute) |
|---|---|---|---|---|
| Bombardment 1 | 600 | Ti | 1 | 15 |
| Bombardment 2 | 820 | Ar | 2 | 20 |
| Bombardment 3 | 1000 | $N_2$ | 4 | 30 |
| Bombardment 4 | 400 | Ar | 2 | 15 |

TABLE 13

| | Coating layer (coating layerA) | | | |
|---|---|---|---|---|
| Sample No | Pretreatment | Composition | | Thickness (μm) |
| 1 | Bombardment 1 | $Ti_{0.5}Al_{0.5}N$ | TiN | 3.0 |
| 2 | Bombardment 2 | $Ti_{0.42}Al_{0.48}W_{0.04}Si_{0.03}Nb_{0.03}N$ | — | 3.5 |
| 3 | Bombardment 1 | $Ti_{0.46}Al_{0.49}W_{0.02}Si_{0.01}Nb_{0.02}N$ | $Ti_{0.42}Al_{0.49}Nb_{0.09}N$ | 4.5 |
| 4 | Bombardment 3 | TiCN | — | 3.0 |
| 5 | Blasting + Bombardment1 | $Ti_{0.50}Al_{0.50}N$ | — | 4.0 |
| 6 | Bombardment 3 | $Ti_{0.42}Al_{0.49}Nb_{0.09}N$ | — | 4.5 |
| 7 | Bombardment 2 | $Ti_{0.46}Al_{0.49}Si_{0.03}Nb_{0.02}N$ | — | 4.0 |
| *8 | Bombardment 4 | TiCN | — | 3.5 |
| *9 | Blasting + Bombardment1 | $Ti_{0.50}Al_{0.50}N$ | — | 3.0 |
| *10 | Bombardment 1 | $Ti_{0.40}Al_{0.40}Cr_{0.20}N$ | — | 3.5 |
| *11 | Bombardment 3 | $Ti_{0.45}Al_{0.45}Si_{0.10}N$ | — | 0.8 |
| *12 | Bombardment 1 | $Ti_{0.42}Al_{0.48}Zr_{0.10}N$ | — | 2.0 |
| *13 | Bombardment 1 | $Ti_{0.46}Al_{0.49}Si_{0.03}Cr_{0.02}N$ | — | 2.5 |

TABLE 13-continued

| Sample No | Coating layer (coating layerA) Pretreatment | Composition | | Thickness (μm) |
|---|---|---|---|---|
| *14 | Bombardment 2 | $Ti_{0.45}Al_{0.45}Cr_{0.10}N$ | — | 3.5 |
| *15 | Bombardment 1 | $Ti_{0.42}Al_{0.48}W_{0.04}Si_{0.03}Nb_{0.03}N$ | — | 2.5 |

Asterisk (*) indicates sample out of range of present invention

The residual stress of the second hard phase ($\sigma_{11}$[2*cf*]) in each of the obtained tools was measured through the surface of the coating layer at a position of the flank face 3 immediately below the cutting edge by using the 2D method (the same measuring conditions as above). The results were shown in Table 15. The mean particle diameters of the first hard phase and the second hard phase, and their respective content ratios were calculated similarly to Example 1. The results were shown in Table 14.

TABLE 14

| Sample No. | Interior region d μm | $d_{1i}$ μm | $d_{2i}$ μm | $d_{2i}/d_{1i}$ | $S_{1i}$ area % | $S_{2i}$ area % | $S_{2i}/S_{1i}$ | Surface region $d_{1s}$ | $d_{2s}$ | $d_{2s}/d_{1s}$ | $S_{1s}$ area % | $S_{2s}$ area % | $S_{2s}/S_{1s}$ |
|---|---|---|---|---|---|---|---|---|---|---|---|---|---|
| 1 | 0.31 | 1.24 | 4.00 | 52.4 | 47.6 | 0.91 | 0.30 | 1.39 | 4.63 | 16.8 | 83.2 | 4.95 | 1.75 |
| 2 | 0.38 | 1.91 | 5.03 | 44.6 | 55.4 | 1.24 | 0.39 | 2.05 | 5.26 | 10.3 | 89.7 | 8.71 | 1.62 |
| 3 | 0.35 | 1.48 | 4.23 | 49.3 | 50.7 | 1.03 | 0.35 | 1.20 | 3.43 | 24.6 | 75.4 | 3.07 | 1.49 |
| 4 | 0.29 | 0.78 | 2.69 | 74.6 | 25.4 | 0.34 | 0.36 | 2.51 | 6.97 | 29.1 | 70.9 | 2.44 | 2.79 |
| 5 | 0.36 | 1.73 | 4.81 | 54.5 | 45.5 | 0.83 | 0.34 | 0.94 | 2.76 | 20.2 | 79.8 | 3.95 | 1.75 |
| 6 | 0.38 | 1.43 | 3.76 | 49.0 | 51.0 | 1.04 | 0.32 | 1.53 | 4.78 | 19.5 | 80.5 | 4.13 | 1.58 |
| 7 | 0.34 | 1.32 | 3.88 | 50.5 | 49.5 | 0.98 | 0.20 | 1.36 | 6.80 | 45.3 | 54.7 | 1.21 | 1.11 |
| *9 | 0.33 | 1.38 | 4.18 | 48.7 | 51.3 | 1.05 | 0.42 | 1.44 | 3.43 | 55.8 | 44.2 | 0.79 | 0.86 |
| *10 | 0.36 | 1.19 | 3.31 | 50.5 | 49.5 | 0.98 | 0.29 | 1.25 | 4.31 | 48.9 | 51.1 | 1.04 | 1.03 |
| *11 | 0.38 | 1.29 | 3.39 | 48.5 | 51.5 | 1.06 | 0.29 | 1.32 | 4.55 | 68.8 | 31.2 | 0.45 | 0.61 |
| *12 | 0.42 | 1.64 | 3.90 | 38.0 | 62.0 | 1.63 | 0.31 | 1.46 | 4.71 | 38.5 | 61.5 | 1.60 | 0.99 |
| *13 | 0.39 | 1.86 | 4.77 | 41.8 | 58.2 | 1.39 | 0.26 | 1.22 | 4.69 | 61.2 | 38.8 | 0.63 | 0.67 |
| *14 | 0.82 | 0.37 | 1.31 | 3.54 | 42.0 | 58.0 | 1.38 | 0.39 | 1.35 | 3.46 | 32.8 | 67.2 | 2.05 |
| *15 | 0.89 | 0.48 | 0.95 | 1.98 | 45.0 | 55.0 | 1.22 | 0.42 | 1.43 | 3.40 | 38.7 | 61.3 | 1.58 |
| *16 | 0.75 | 0.33 | 1.15 | 3.48 | 30.5 | 69.5 | 2.28 | 0.38 | 1.31 | 3.45 | 20.2 | 79.8 | 3.95 |

Asterisk (*) indicates sample out of range of present invention

Using the cutting tools made of the obtained cermets, cutting tests were conducted under the following cutting conditions. The results were shown together in Table 15.

(Wear Resistance Evaluation)

Work material: SCM435

Cutting speed: 250 m/min

Feed rate: 0.20 mm/rev

Depth of cut: 1.0 mm

Cutting state: wet (using water-soluble cutting fluid)

Evaluation method: time elapsed until the amount of wear reached 0.2 mm (Fracture Resistance Evaluation)

Work material: SCM45C

Cutting speed: 120 m/min

Feed rate: 0.05 mm/rev or more

Depth of cut: 1.5 mm

Cutting state: dry

Evaluation method: time (sec) elapsed until fracture occurs by each feed rate 10 S.

TABLE 15

| Sample No. | Residual stress (MPa) Before coating $\sigma_{11}$[2nf] | After coating $\sigma_{11}$[2cf] | $\sigma_{11}$[2cf]/$\sigma_{11}$[2nf] | Cutting performance Fracture resistance (second) | Wear resistance (minute) |
|---|---|---|---|---|---|
| 1 | −235 | −377 | 1.60 | 90 | 125 |
| 2 | −253 | −315 | 1.25 | 85 | 140 |

TABLE 15-continued

| Sample No. | Residual stress (MPa) Before coating $\sigma_{11}$[2nf] | After coating $\sigma_{11}$[2cf] | $\sigma_{11}$[2cf]/$\sigma_{11}$[2nf] | Cutting performance Fracture resistance (second) | Wear resistance (minute) |
|---|---|---|---|---|---|
| 3 | −275 | −353 | 1.28 | 96 | 155 |
| 4 | −225 | −285 | 1.27 | 78 | 110 |
| 5 | −210 | −258 | 1.23 | 75 | 107 |
| 6 | −230 | −285 | 1.24 | 80 | 114 |
| 7 | −243 | −293 | 1.21 | 88 | 120 |
| *8 | −215 | −228 | 1.06 | 58 | 105 |
| *9 | −90 | −134 | 1.49 | 57 | 106 |
| *10 | −140 | −178 | 1.27 | 53 | 108 |
| *11 | −232 | −241 | 1.04 | 42 | 93 |
| *12 | −220 | −235 | 1.07 | 48 | 103 |
| *13 | −125 | −135 | 1.08 | 48 | 100 |
| *14 | −130 | −160 | 1.23 | 63 | 85 |
| *15 | −100 | −130 | 1.30 | 38 | 92 |

Asterisk (*) indicates sample out of range of present invention

The following were noted from Tables 10 to 15. That is, in the samples No. III-8 to III-15 which had the residual stress beyond the range of the present invention, the tool toughness was insufficient, and the chipping of the cutting edge and the sudden fracture of the cutting edge occurred early, failing to obtain a sufficient tool life. On the contrary, the samples Nos. III-1 to III-7 within the range of the present invention had high toughness, and therefore no chipping of the cutting edge occurred, exhibiting an excellent tool life.

DESCRIPTION OF REFERENCE NUMERALS

1: tip (throw-away tip)
2: rake face
3: flank face
4: cutting edge
5: nose
6: sintered cermet
8: breaker groove
11: hard phase
12: first hard phase
13: second hard phase
14: binder phase $\sigma_{11}$ direction: a direction parallel to the rake face and goes from the center of the rake face to the nose being the closest to a measuring point; and $\sigma_{22}$ direction: a direction parallel to the rake face and vertical to the $\sigma_{11}$ direction

The invention claimed is:

1. A culling tool, comprising:
a sintered cermet, which contains
a hard phase comprising one or more selected from among carbides, nitrides, and carbonitrides which comprise mainly Ti and contain one or more metals selected from among metals of Groups 4, 5, and 6 in the periodic table, and
a binder phase comprising mainly at least one of Co and Ni; and
a cutting edge which lies along an intersecting ridge portion between a rake face and a flank face, and comprises a nose lying on the cutting edge located between the flank faces adjacent to each other, wherein
the hard phase comprises a first hard phase and a second hard phase, and
when a residual stress is measured in the rake face by 2D method, a residual stress $\sigma_{11}[\mathbf{1}r]$ of the first hard phase in a direction ($\sigma_{11}$ direction), which is parallel to the rake face and goes from the center of the rake face to the nose being the closest to a measuring point, is 50 MPa or below in terms of compressive stress ($\sigma_{11}[\mathbf{1}r]$=−50 to 0 MPa), and a residual stress $\sigma_{11}[\mathbf{2}r]$ of the second hard phase in the $\sigma_{11}$ direction is 150 MPa or above in terms of compressive stress ($\sigma_{11}[\mathbf{2}r]\leq-150$ MPa).

2. The cutting tool according to claim 1, wherein a ratio of the residual stress $\sigma_{11}[\mathbf{1}r]$ of the first hard phase in the direction $\sigma_{11}$ and the residual stress $\sigma_{11}[\mathbf{2}r]$ of the second hard phase in the direction $\sigma_{11}$ ($\sigma_{11}[\mathbf{1}r]/\sigma_{11}[\mathbf{2}r]$) is 0.05 to 0.3.

3. The cutting tool according to claim 1, wherein the residual stress $\sigma_{11}[\mathbf{2}rA]$ of the second hard phase measured in the vicinity of the cutting edge in the rake face has a smaller absolute value than the residual stress $\sigma_{11}[\mathbf{2}rB]$ of the second hard phase measured at the center of the rake face.

4. The cutting tool according to claim 1, wherein, when a residual stress is measured on the rake face by the 2D method, a residual stress $\sigma_{22}[\mathbf{1}r]$ of the first hard phase in a direction ($\sigma_{22}$ direction), which is parallel to the rake face and vertical to the $\sigma_{11}$ direction, is 50 to 150 MPa in terms of compressive stress ($\sigma_{22}[\mathbf{1}r]$=−150 to −50 MPa), and a residual stress $\sigma_{22}[\mathbf{2}r]$ of the second hard phase in the $\sigma_{22}$ direction is 200 MPa or above in terms of compressive stress ($\sigma_{22}[\mathbf{2}r]\leq-200$ MPa).

5. The cutting tool according to claim 1, wherein a ratio of $d_{1i}$ and $d_{2i}$ ($d_{2i}/d_{1i}$) in an inner of the cutting tool, where $d_{1i}$ is a mean particle diameter of the first hard phase and $d_{2i}$ is a mean particle diameter of the second hard phase, is 2 to 8.

6. The cutting tool according to claim 5, wherein a ratio of $S_{1i}$ and $S_{2i}$ ($S_{2i}/S_{1i}$), where $S_{1i}$ is a mean area occupied by the first hard phase and $S_{2i}$ is a mean area occupied by the second hard phase with respect to the entire hard phases, is 1.5 to 5.

7. A cutting tool, comprising:
a sintered cermet, which contains
a hard phase comprising one or more selected from among carbides, nitrides, and carbonitrides which comprise mainly Ti and contain one or more metals selected from among metals of Groups 4, 5, and 6 in the periodic table, and
a binder phase comprising mainly at least one of Co and Ni; and
a cutting edge lying along an intersecting ridge portion between a rake face and a flank face, wherein
the hard phase comprises a first hard phase and a second hard phase,
when a residual stress is measured by 2D method on a surface of the sintered cermet which corresponds to the flank face immediately below the cutting edge, a residual stress $\sigma_{11}[\mathbf{2}sf]$ of the second hard phase in a direction ($\sigma_{11}$ direction), which is parallel to the rake face and is an in-plane direction of the flank face, is 200 MPa or above in terms of compressive stress ($\sigma_{11}[\mathbf{2}sf]\leq-200$ MPa), and
when a residual stress is measured by the 2D method on a ground surface obtained by grinding 400 μm or more from the surface of the sintered cermet which corresponds to the flank face immediately below the cutting edge, a residual stress $\sigma_{11}[\mathbf{2}if]$ in the $\sigma_{11}$ direction is 150 MPa or above in terms of compressive stress ($\sigma_{11}[\mathbf{2}if]\leq-150$ MPa), and has a smaller absolute value than the residual stress $\sigma_{11}[\mathbf{2}sf]$, and
wherein the sintered body is not polished.

8. The cutting tool according to claim 7, wherein
when a residual stress is measured by the 2D method on the surface of the sintered cermet which corresponds to the flank face immediately below the cutting edge, a residual stress $\sigma_{11}[\mathbf{1}sf]$ of the first hard phase in the $\sigma_{11}$ direction is 70 to 180 MPa in terms of compressive stress ($\sigma_{11}[\mathbf{1}sf]$=−180 to −70 MPa), and
when a residual stress is measured by the 2D method on a ground surface obtained by grinding 400 μm or more from the surface of the sintered cermet in the flank face, a residual stress $\sigma_{11}[\mathbf{1}if]$ in the $\sigma_{11}$ direction is 20 to 70 MPa in terms of compressive stress ($\sigma_{11}[\mathbf{1}if]$=−70 to −20 MPa), and has a smaller absolute value than the residual stress $\sigma_{11}[\mathbf{1}sf]$.

9. The cutting tool according to claim 7, wherein a ratio of the residual stress $\sigma_{11}[\mathbf{1}sf]$ and the residual stress $\sigma_{11}[\mathbf{2}sf]$ ($\sigma_{11}[\mathbf{2}sf]/\sigma_{11}[\mathbf{1}sf]$) is 1.2 to 4.5.

10. The cutting tool according to claim 7, wherein a ratio of $S_{1i}$ and $S_{2i}$ ($S_{2i}/S_{1i}$), where $S_{1i}$ is a mean area occupied by the first hard phase and $S_{2i}$ is a mean area occupied by the second hard phase with respect to the entire hard phases in an interior of the sintered cermet, is 1.5 to 5.

11. The cutting tool according to claim 10, wherein a surface region in which a ratio of $S_{1s}$ and $S_{2s}$ ($S_{2s}/S_{1s}$), where $S_{1s}$ is a mean area occupied by the first hard phase and $S_{2s}$ is a mean area occupied by the second hard phase with respect to the entire hard phases, is 2 to 10, is in the surface of the sintered cermet.

12. The cutting tool according to claim 10, wherein the ratio of $S_{2i}$ and $S_{2s}$ ($S_{2s}/S_{2i}$) is 1.5 to 5.

13. A cutting tool, comprising:

a base comprising sintered cermet, which contains a hard phase comprising one or more selected from among carbides, nitrides and carbonitrides which comprise mainly Ti and contain one or more metals selected from among metals of Groups 4, 5, and 6 in the periodic table. and a binder phase comprising mainly at least one of Co and Ni; and a cutting edge lying along an intersecting ridge portion between a rake face and a flank face, wherein the hard phase comprises a first hard phase and a second hard phase, when a residual stress is measured by 2D method on a surface of the sintered cermet which corresponds to the flank face immediately below the cutting edge, a residual stress $\sigma_{11}[\mathbf{2}sf]$ of the second hard phase in a direction ($\sigma_{11}$ direction), which is parallel to the rake face and is an in-plane direction of the flank face, is 200 MPa or above in terms of compressive stress ($\sigma_{11}[\mathbf{2}sf] \leq -200$ MPa), and when a residual stress is measured by the 2D method on a ground surface obtained by grinding 400 μm or more from the surface of the sintered cermet which corresponds to the flank face immediately below the cutting edge, a residual stress $\sigma_{11}[\mathbf{2}if]$ in the $\sigma_{11}$ direction is 150 MPa or above in terms of compressive stress $\sigma_{11}[\mathbf{2}if] \leq -150$ MPa), and has a smaller absolute value than the residual stress $\sigma_{11}[\mathbf{2}sf]$ a coating layer formed on the surface of the base, wherein when a residual stress on the flank face is measured through the surface of the coating layer by the 2D method, a residual stress ($\sigma_{11}[\mathbf{2}cf]$) of the second hard phase in a direction ($\sigma_{11}$ direction), which is parallel to the rake face and is an in-plane direction of the flank face, is 200 MPa or above in terms of compressive stress ($\sigma_{11}[\mathbf{2}cf] \leq -200$ MPa), and the residual stress $\sigma_{11}[\mathbf{2}cf]$ is 1.1 times or more a residual stress ($\sigma_{11}[\mathbf{2}nf]$) of the second hard phase of the sintered cermet before forming the coating layer, in the $\sigma_{11}$ direction.

14. The cutting tool according to claim 13, wherein the coating layer comprises $Ti_{1-a-b-c-d}Al_aW_bSi_cM_d(C_xN_{1-x})$, where M is one or more selected from among Nb, Mo, Ta, Hf, and Y, $0.45 \leq a \leq 0.55$, $0.01 \leq b \leq 0.1$, $0 \leq c \leq 0.05$, $0 \leq d \leq 0.1$, and $0 \leq x \leq 1$.

* * * * *